United States Patent [19]

Yamamoto et al.

[11] Patent Number: 4,931,322

[45] Date of Patent: Jun. 5, 1990

[54] METHOD AND APPARATUS FOR PAINTING OBJECT

[75] Inventors: Tohru Yamamoto; Tadashi Takeo; Kiyohiro Ichinose; Syogo Ozawa; Kenji Fujii; Saburo Fujii; Mashayuki Enomoto; Ichiro Ishibashi; Junichi Murayama, all of Sayama, Japan

[73] Assignee: Honda Giken Kogyo Kabushiki

[21] Appl. No.: 32,712

[22] Filed: Apr. 1, 1987

[30] Foreign Application Priority Data

| | | | |
|---|---|---|---|
| Apr. 1, 1986 | [JP] | Japan | 61-76086 |
| Apr. 1, 1986 | [JP] | Japan | 61-76087 |
| Apr. 1, 1986 | [JP] | Japan | 61-76088 |
| Apr. 1, 1986 | [JP] | Japan | 61-49374[U] |
| Apr. 1, 1986 | [JP] | Japan | 61-49375[U] |
| Apr. 1, 1986 | [JP] | Japan | 61-49376[U] |
| Apr. 1, 1986 | [JP] | Japan | 61-49377[U] |
| Dec. 22, 1986 | [JP] | Japan | 61-305795 |
| Feb. 3, 1987 | [JP] | Japan | 62-13776[U] |

[51] Int. Cl.[5] ..... B05D 1/02

[52] U.S. Cl. ..... 427/421; 118/315; 118/316; 118/323

[58] Field of Search ..... 427/421, 424; 118/323, 118/315, 316, 697

[56] References Cited

U.S. PATENT DOCUMENTS

| | | | |
|---|---|---|---|
| 2,900,950 | 8/1959 | Peeps | 118/323 X |
| 3,027,273 | 3/1962 | Sacks | 118/323 |
| 3,402,697 | 9/1968 | Kock | 118/323 X |
| 3,496,908 | 2/1970 | Bernardi | 118/323 X |
| 3,509,852 | 5/1970 | Wells | 118/323 |
| 3,533,422 | 10/1970 | Alimanestiano | 118/323 X |
| 3,619,311 | 11/1971 | Rose | 118/323 X |
| 3,742,906 | 7/1973 | Dupke . | |
| 3,924,565 | 12/1975 | Benner et al. | 118/323 |
| 4,209,557 | 6/1980 | Edwards | 118/323 |
| 4,278,046 | 7/1981 | Clarke et al. | 118/323 X |
| 4,590,654 | 5/1986 | Kayiura | 118/697 |

FOREIGN PATENT DOCUMENTS

| | | |
|---|---|---|
| 0084523 | 1/1983 | European Pat. Off. . |
| 806765 | 12/1958 | United Kingdom . |
| 1322861 | 7/1973 | United Kingdom . |
| 2200304 | 8/1988 | United Kingdom . |

*Primary Examiner*—Shrive Beck

[57] ABSTRACT

An object having three-dimensional surface such as an automotive vehicle body is painted by painting mechanisms movable along a transfer path near the object. Each of the painting mechansims has a plurality of paint spray guns displaceable dependent on the surfaces to be painted, the paint spray guns being adjustably located at optimum distances and angles with respect to the surfaces to be painted for applying a uniform paint coat to the object. No pain runs and sags will be formed on the coated surfaces.

5 Claims, 24 Drawing Sheets

METHOD AND APPARATUS FOR PAINTING OBJECT

BACKGROUND OF THE INVENTION

The present invention relates a method of and an apparatus for painting an object, and more particularly to a method of and an apparatus for painting inner surfaces and outer surfaces such as side and upper surfaces of an automotive vehicle body without paint coat irregularities and efficiently within a small space, so that painted products of high quality can be obtained.

Automobile industry in recent years employs highly automated line production processes for efficiently mass-producing automobile products. To meet desired mass-production requirements, there are used assembling apparatus for assembling individual parts and conveyor apparatus for conveying components to respective working positions. Painting apparatus for painting automobile bodies are also automated.

Various methods have heretofore been employed for automatically painting automobile bodies. According to one known painting method, for example, an automotive vehicle body is conveyed by a conveyor apparatus, and paint spray applied from a plurality of paint spray guns to side panels, an engine hood, a roof, and a trunk lid of the vehicle body as it is conveyed, so that the vehicle body will be painted.

In the above painting method, however, the vehicle body tends to vibrate while it is being conveyed, with the result that a desired paint coating will not be applied accurately but paint coat irregularities will result. Vehicle body painting is one of the critical requirements for determining the quality of completed automobiles. Automobiles with paint coat irregularities or defects cannot be sold in the market. Automotive vehicle bodies with such a defective coating must be painted again to mend the paint defect.

If a vehicle body being conveyed while a paint coat is being applied is positionally displaced as well as vibrated, a paint defect will also arise. Therefore, vehicle bodies must be fixed in position with respect to the conveyor apparatus. However, the procedure for securing the vehicle bodies against vibration and positional displacement is tedious and time consuming.

Another painting method which has been used keeps an automotive vehicle body at rest in a painting position and displaces a painting apparatus with a plurality of paint spray guns with respect to the vehicle body for coating the same. The paint spray guns are arranged in an inverted U-shaped pattern so that they confront the side panels and upper panel of the vehicle body. More specifically, the inverted U-shaped painting apparatus includes two side painting mechanisms located on opposite sides and each having a plurality of paint spray guns, and an upper painting mechanism located on the upper side and having a plurality of paint spray guns directed downwardly. The upper and side painting mechanisms are displaced in unison by a conveyor mechanism with respect to the vehicle body, and a paint coating is applied all over the vehicle body by the paint spray guns.

However, since the upper and side painting mechanisms are moved in unison with respect to the vehicle body, a complex process is required for controlling the upper and side painting mechanisms. More specifically, the upper and side panels of the vehicle body to be painted are of different surface areas, and the upper panel surface lies substantially horizontally whereas the side panel surfaces are inclined considerably with respect to the vertical direction. In order to paint the upper and side panel surfaces appropriately, therefore, the spray guns must be moved at different speeds, and painting conditions such as the rates at which the paint is delivered from the spray guns must be different from painting mechanism to painting mechanism. With the conventional inverted U-shaped painting apparatus, since the upper and side painting mechanisms are moved at the same speed, the coating film on the upper panel surface of the vehicle body tends to be of a small thickness, or paint runs and sags are apt to be produced on the side panel surfaces. Therefore, the rates of discharge of the paint from the spray guns should carefully be controlled.

Where the upper and side painting mechanisms are moved together, the spray guns in the uppermost position on the side painting mechanisms and those at the ends of the upper painting mechanism spray the paint in very close areas, and hence the paint sprays from these spray guns interfere with each other. In electrostating painting where paint is applied under electrostatic forces, the paint particles are electrostatically repelled from each other, resulting in a greater tendency of paint spray interference. Moreover, the paint coat is apt to have different thicknesses which will have to be made uniform by re-painting. Thus, the entire painting procedure is complex, making it difficult to accomplish an efficient automobile production process.

SUMMARY OF THE INVENTION

In view of the aforesaid difficulties of the conventional painting methods and apparatus, it is an object of the present invention to provide a method and an apparatus for painting an object having three-dimensional surfaces such as an automotive vehicle body with painting mechanisms movable back and forth along a transfer path and having a plurality of paint spray guns displaceable dependent on the surfaces to be painted. The paint spray guns are adjustably located at optimum distances and angles with respect to the surfaces to be painted for applying a uniform paint coat to the object, so that no paint runs and sags will be formed on the coated surfaces. The painting mechanisms are being movable in a simplified control process, while allowing the object to be painted effectively in a small space.

It is a primary object of the present invention to provide a method of painting an object having opposite side surfaces and an upper surface, comprising the steps of:

applying paint sprays ejected from a plurality of paint spraying means to said opposite side surfaces and upper surface; and moving said arms independently in mutually positionally displaced relation to allow the paint sprays from the paint spraying means to be coated on the surfaces of the object substantially without mutual interference of the paint sprays.

Another object of the present invention is to provide a painting method wherein the surfaces of the object are painted in a first linear pattern by said paint spraying means while moving said arms, and then unpainted areas of the surfaces of the object are painted in a second linear pattern by said paint spraying means which are displaced.

Still another object of the present invention is to provide a method for painting an object having a surface including a bent or curved portion, comprising the steps of:

moving paint spraying means and applying paint sprays therefrom to said surface of the object while they are being directed substantially perpendicularly to and spaced a constant distance from the surface of the object;

turning said paint spray means so as to be directed substantially perpendicularly to and spaced a constant distance from the bent or curved portion of the surface of the object;

then moving said paint spray means and applying paint sprays therefrom to said bent or curved portion; and repeating the above steps to paint the object.

Yet another object of the present invention is to provide a method of painting an object having a surface, comprising the steps of:

delivering the object along a painting line with said object having a longitudinal direction substantially perpendicular to a painting direction;

moving said object and paint spraying means relatively in said painting direction;

directing said paint spraying means substantially perpendicularly to said surface of the object and keeping the paint spraying means a prescribed distance from said surface of the object; and then applying paint sprays from said paint spraying means to said surface for thereby painting said object.

Yet still another object of the present invention is to provide an apparatus for painting an object having opposite side surfaces and an upper surface, comprising:

a first painting mechanism movable along one of said side surfaces for painting said one side surface;

a second painting mechanism movable along the other side surface independently of said first painting mechanism for painting said other side surface; and a third painting mechanism movable along said upper surface independently of said first and second painting mechanisms for painting said upper surface.

A further object of the present invention is to provide a painting apparatus wherein said first, second, and third painting mechanisms are displaceable along independent paths, respectively, extending in said painting direction.

A still further object of the present invention is to provide a painting apparatus wherein each of said first, second, and third painting mechanisms has paint spraying means for applying paint sprays to said object.

A yet further object of the present invention is to provide a painting apparatus wherein there are a plurality of paint spray means spaced at prescribed distances in a first direction normal to the direction in which said first, second, and third painting mechanisms are movable, each of said first, second, and third painting mechanisms having shifting means for shifting said paint spray means in said first direction in which they are spaced.

A yet still further object of the present invention is to provide a painting apparatus wherein said paint spray means comprises a first group of spray nozzles spaced at prescribed distances in a first direction normal to the second direction in which said first, second, and third painting mechanisms are movable, and a second group of spray nozzles spaced at a prescribed distance from said first group of nozzles in said second direction and displaced a prescribed interval from said first group of nozzles in said first direction.

Another object of the present invention is to provide an apparatus for painting an object in a transverse direction thereof which is delivered along a painting line, the object having opposite longitudinal end surfaces, opposite transverse side surfaces, and an upper surface, comprising:

a first painting mechanism for painting said side and upper surfaces of the object, said first painting mechanism having an angularly movable and/or vertically movable arm extending substantially longitdinally of the object, and a plurality of paint spraying means mounted on said arm in spaced relation; and a second painting mechanism for painting said end surfaces of the object.

Still another object of the present invention is to provide a painting apparatus wherein said first painting mechanism includes a mobile body movable substantially in the transverse direction of the object, said arm being mounted on said mobile body, at least one of said paint spraying means mounted on said arm being movable toward and away from said arm and/or swingable with respect to said arm.

Yet another object of the present invention is to provide a painting apparatus wherein said second painting mechanism includes a mobile body movable substantially in the transverse direction of the object, and at least one paint spraying means mounted on said mobile body.

Yet still another object of the present invention is to provide an apparatus for painting an object having a surface, comprising:

a first mobile body movable along said object;

a second mobile body mounted on said first mobile body and movable while being directed toward said object;

paint spraying means mounted on said second mobile body and directed toward said object for applying paint sprays to said surface of the object; and turning means for turning said paint spraying means about an axis normal to the direction in which said first and second mobile bodies are movable.

A further object of the present invention is to provide a painting apparatus further including a guide rail disposed on one side of the object, and a first drive source, said first mobile body being movable along said guide rail by said first drive source.

A yet further object of the present invention is to provide a painting apparatus further including a second drive source, said second movable body being movable in a vertical direction along said first mobile body by said second drive source, said paint spraying means being angularly movable by said turning means for applying paint sprays substantially perpendicularly to said surface of the object.

A still further object of the present invention is to provide a painting apparatus further including shifting means for shifting said paint spraying means along said axis.

A yet still further object of the present invention is to provide an apparatus for painting an object having first, second, and third surfaces, comprising:

moving means;

first, second, and third painting mechanisms having paint spraying means for applying paint sprays to the first, second, and third surfaces, respectively, of the object while said first, second, and third painting mechanims are being moved by said moving means in the vicinity of the object;

said first, second, and third painting mechanisms having first, second, and third painting distance adjusting means, respectively, for moving said paint spraying means toward and away from said object;

at least one of said first, second, and third painting mechanisms having painting angle adjusting means for modifying the posture of the paint spraying means thereof by swinging the latter; and whereby the distances between the paint spraying means of said first, second, and third painting mechanisms and said first, second, and third surfaces of the object can be equalized by said first, second, and third painting distance adjusting means, respectively, and the angle of said paint spraying means of the painting machanism which has said painting angle adjusting means with respect to the corresponding surface of the object can be kept constant by said painting angle adjusting means.

Another object of the present invention is to provide a painting apparatus wherein said object comprises an automotive vehicle body, said first, second, and third surfaces of the object corresponding to an upper portion of the vehicle body including a front body surface, an engine hood, a roof, a trunk lid, and a rear body surface, a lefthand side surface including a lefthand door, and a righthand side surface including a righthand door, said painting angle adjusting means being incorporated in said first painting mechanism which paints said upper portion of the vehicle body.

Still another object of the present invention is to provide a painting apparatus wherein each of said first, second, and third painting distance adjusting means comprises a servomotor, a ball screw coupled to a drive shaft of said servomotor, and a holder mechanism held in threaded engagement with said ball screw and holding a swing arm on which said paint spraying means is mounted, whereby said ball screw can be rotated by said servomotor for displacing said holder mechanism to adjust the distance between the paint spraying means and one of the surfaces of the object.

Yet another object of the present invention is to provide a painting apparatus wherein each of said first, second, and third painting distance adjusting means comprises a servocylinder, a post engaging a piston rod of said servocylinder, and a gun arm fixed to said servocylinder and supporting said paint spraying means, whereby said servocylinder can be driven to displace the servocylinder and said gun arm in unison to adjust the distance between the paint spraying means and one of the surfaces of the object.

Yet still another object of the present invention is to provide a painting apparatus wherein said painting distance adjusting means includes a holder mechanism, said painting angle adjusting means comprising a servomotor held by said holder mechanism, a first gear mounted on a drive shaft of said servomotor, a second gear meshing with said first gear, and a swing arm coupled to said second gear, whereby said servomotor can be driven to rotate said first and second gears to tilt said swing arm for adjusting the angle of a distal end of said paint spraying means.

A further object of the present invention is to provide an apparatus for painting an object having an upper portion, comprising:

an upper painting mechanism having a plurality of paint spraying means and displaceable with respect to the object for applying paint sprays from said paint spraying means to said upper portion of the object in a painting direction;

shifting means mounted on said upper painting mechanism for shifting said paint spraying means in a direction different from said painting direction; and said shifting means comprising a displaceable outer cylindrical member on which said paint spraying means are mounted, an inner cylindrical member having one end fixed to a body of said upper painting mechanism and fitted in said outer cylindrical member for guiding the same, and an actuator for moving said outer cylindrical member axially back and forth;

said upper painting mechanism further including a cover fixed to one end of said outer cylindrical member in surrounding relation to relatively slidable portions of said outer and inner cylindrical members, and a joint displaceably interconnecting the other end of said outer cylindrical member and said actuator.

A still further object of the present invention is to provide a painting apparatus wherein said actuator comprises a cylinder, further including a rod attached to said cylinder and inserted through said inner cylindrical member, said outer cylindrical member engaging an end of said rod through an engagement member, whereby said cylinder can be operated to cause said rod to move said outer cylindrical member for thereby shifting said paint spraying means on the outer cylindrical member in said direction different from the painting direction.

A yet further object of the present invention is to provide an apparatus for painting an object, comprising:

a transfer path extending on at least one side of the object;

a painting mechanism movable on said transfer path, said painting mechanism having a roller;

said transfer path comprising a rail on which said roller is rollingly mounted for moving said painting mechanism, and a plate like cover member surrounding said rail and said roller and extending along said transfer path, whereby paint sprays from said painting mechanism are prevented by said cover member from being applied to said rail or said roller when the paint sprays are applied to the object by said painting mechanism while moving on said transfer path.

A yet still further object of the present invention is to provide a painting apparatus wherein said transfer path includes a rail bracket having a pair of rails, said cover member being of an inverted channel-shaped cross section fixed to said rail bracket and surrounding upper and lateral sides of said rails.

Another object of the present invention is to provide a system for painting an inner surface, an outer side surface, and an outer upper surface of an object, comprising:

a painting line composed of a plurality of painting stages for painting the respective surfaces of the object, and a conveyor mechanism for transferring the object, said painting stages having working components for painting said surfaces, respectively, of the object and component controllers for controlling said working components, respectively;

stage master controllers associated respectively with said painting stages, said component controllers being connected to said stage master controllers, respectively; and a line master controller associated with said painting line and connected to said stage master controllers for controlling operation of said conveyor mechanism and transferring information indicative of the type of the object and a paint color to be coated to said stage master controllers in synchronism with operation timing of said conveyor mechanism, said stage master controllers being operable in synchronism with the operation timing of said conveyor mechanism for transferring said information to said component controllers, said component controllers being operable to execute a predetermined operation sequence based on said information for operating said working components to paint the object.

Still another object of the present invention is to provide a painting system wherein said line master controller is operable in synchronism with the starting of said conveyor mechanism for transferring said information to said stage master controller, said stage master controllers being operable in synchronism with the arrival of the object to said painting stages for transferring said information to said component controllers.

Yet another object of the present invention is to provide a painting system wherein each of said component controllers comprises a painting robot controller and a painting controller which are operable based on said information for executing a predetermined painting sequence upon completion of positioning of the object at the painting stages thereby to operate said working components to paint the object.

Yet still another object of the present invention is to provide a painting system wherein each of said component controllers further includes an opening/closing controller operably based on said information for executing a predetermined opening sequence upon completion of the positioning of the object at the painting stages thereby to operate said working components, to open a prescribed portion of the object, and then to apply an opening completion signal to said painting robot controller and said painting controller.

A further object of the present invention is to provide a painting system wherein said painting robot controller applies a closing command to said opening/closing controller upon completion of the painting operation by the working component, said opening/closing controller being responsive to receipt of said closing command for operating said working component to close the prescribed portion of the object.

A still further object of the present invention is to provide a painting system wherein said line master controller is arranged to receive status signals from said conveyor mechanism, each of said painting stages, each of said stage master controllers, each of said component controllers, and each of said working components, and to issue signals indicative of operating and abnormal conditions thereof to a monitor device for thereby monitoring the painting line.

A yet further object of the present invention is to provide a painting system wherein said painting stages include at least a painting stage for opening and closing a prescribed portion of the object and painting an inner surface of the object, and a painting stage for painting an outer surface of the object.

A yet still further object of the present invention is to provide a painting system wherein said painting stages further include a drying stage for drying a paint coat on the object.

The above and other objects, features and advantages of the present invention will become more apparent from the following description when taken in conjunction with the accompanying drawings in which preferred embodiments of the present invention are shown by way of illustrative example.

The present invention will become more fully understood from the detailed description given hereinbelow and the accompanying drawings which are given by way of illustration only, and thus are not limitative of the present invention, and wherein:

DETAILED DESCRIPTION OF THE PREFERRED EMBODIMENTS

Figure 1:
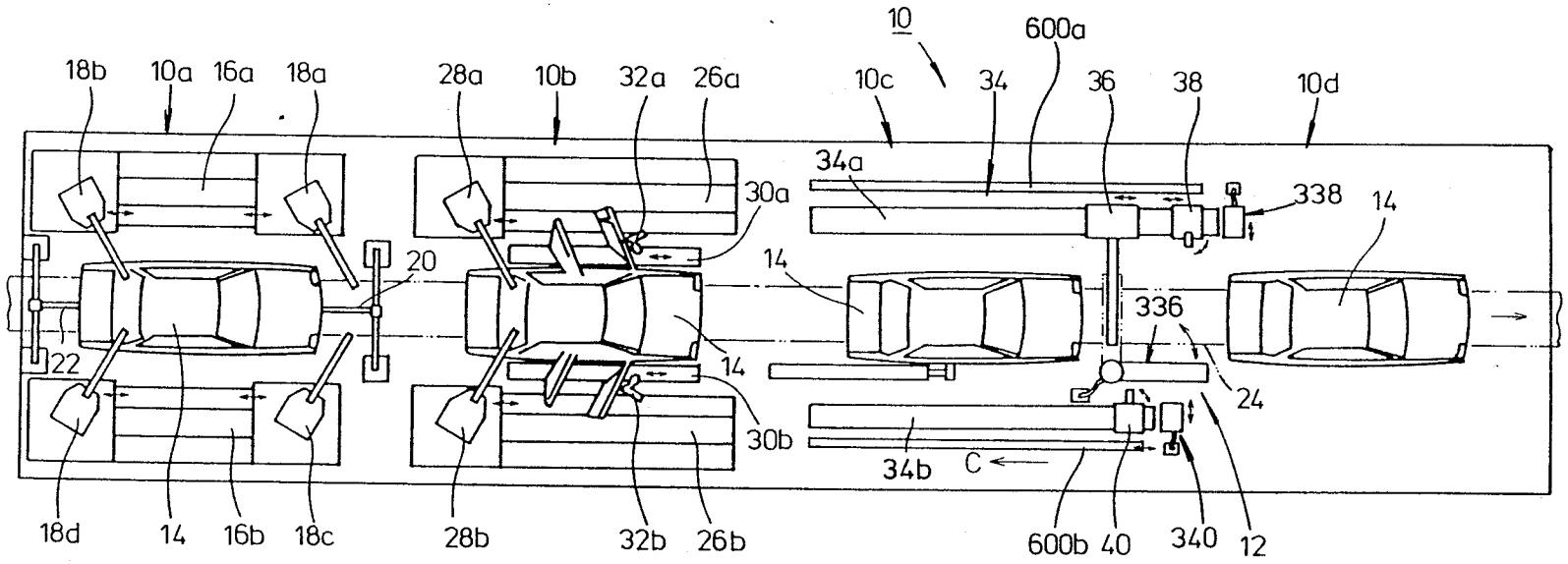
FIG. 1 is a plan view of a painting line according to the present invention.

FIG. 1 shows a painting line 10 for painting automotive vehicle bodies, the painting line 10 is divided into a first painting stage 10*a*, a second painting stage 10*b*, a third painting stage 10*c*, and a fourth painting stage 10*d* for painting respective different areas or surfaces of the vehicle bodies.

In the first painting stage 10*a*, the engine compartment and trunk compartment of each of the vehicle bodies 14 are painted. The first painting stage 10*a* includes painting mechanisms 18*a* through 18*d* movably mounted on rails 16*a*, 16*b* disposed on opposite sides of the first painting stage 10*a*. The first painting stage 10*a* also includes an engine hood opening/closing mechanism 20 and a trunk lid opening/closing mechanism 22. The painting line 20 includes a vehicle body conveyor mechanism 24 extending centrally from the first to fourth painting stages 10*a* through 10*d*.

In the second painting stage 10*b*, the inner surfaces of doors of each vehicle body 14 are painted. The second painting stage 10*b* includes painting mechanisms 28*a*, 28*b* movably mounted respectively on rails 26*a*, 26*b* disposed on opposite sides of the second painting stage 10*b*. Additional rails 30*a*, 30*b* are disposed between the vehicle body conveyor mechanism 24 and the rails 26*a*, 26*b*, and door opening/closing mechanisms 32*a*, 32*b* are movably mounted on the rails 30*a*, 30*b*, respectively.

Figure 3:
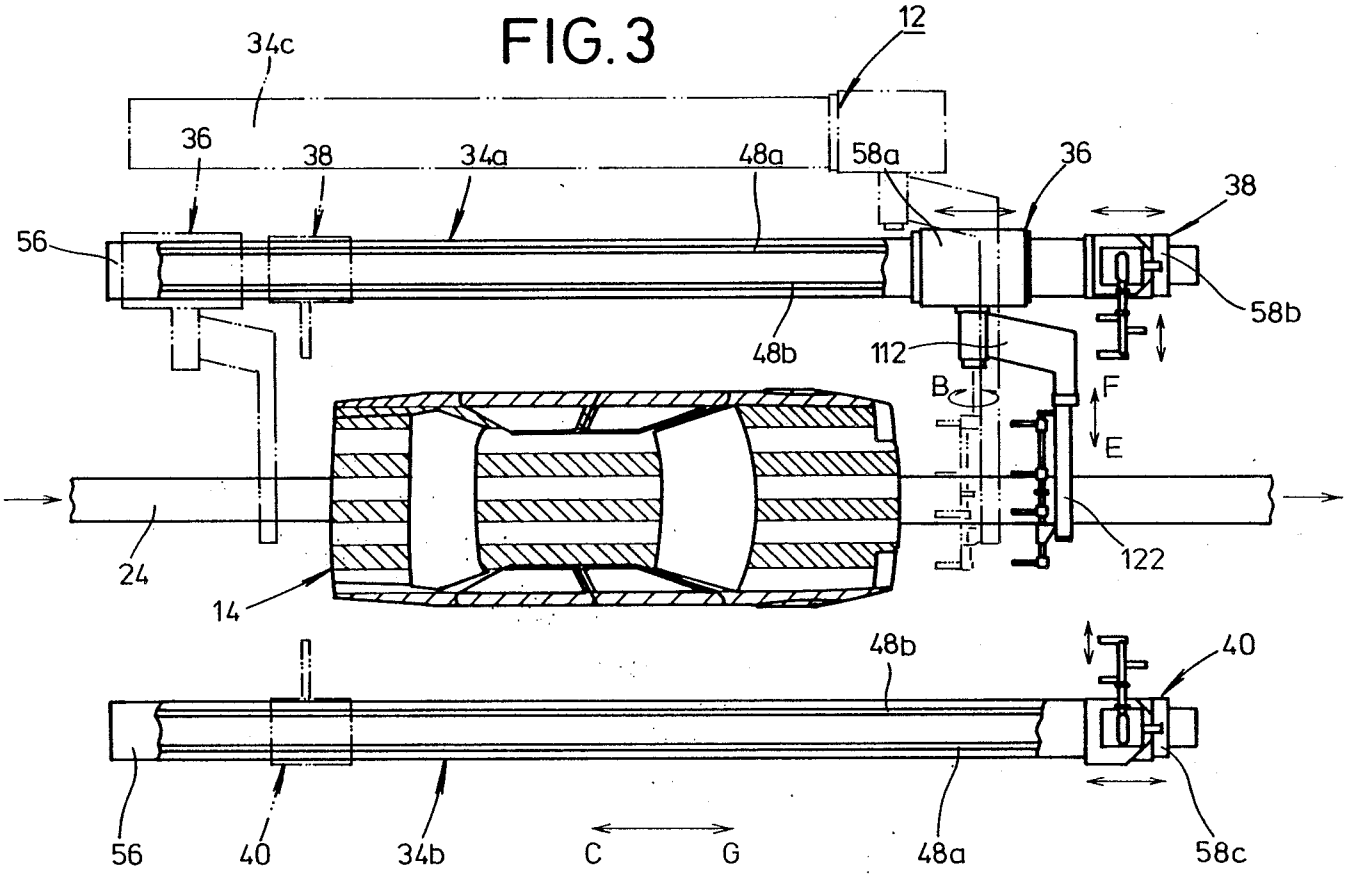
FIG. 3 is a plan view of a painting apparatus of the present invention.

In the third painting stage 10*c*, the outer panels including the engine hood, trunk lid, roof, and doors of each vehicle body 14 are painted. A painting apparatus 12 is disposed in the third painting stage 10*c* for painting the outer panels, and comprises rails 34*a*, 34*b* disposed parallel to each other on the opposite sides of the vehicle body conveyor mechanism 24, an upper painting mechanism 36 and a lefthand side painting mechanism 38 which are movable along the rail 34*a*, and a righthand side painting mechanism 40 movable along the rail 34*b*. The third painting stage 10*c* includes cleaning devices 336, 338, 340 for cleaning paint spray guns of the painting mechanisms 36, 38, 40 when paint colors are to be changed. In this embodiment, the upper painting mechanism 36 is movable along the rail 34*a*. However, as shown in FIG. 3, another rail 34*c* may be disposed outside of the rail 34*a*, and the upper painting mechanism 36 may be movably disposed on the rail 34*c* for travel independent of the lefthand side painting mechanism.

In the fourth stage 30*d*, the painted vehicle body 14 is dried. In the first through third painting stages 10*a*–10*c*, the electrostatic painting process is employed in which the paint is electrostatically applied to the vehicle bodies.

The painting line 10 is controlled by a painting control system 400. The painting control system 400 is mainly composed of a line master controller 410 for controlling the overall painting system, and stage master controllers 412*a*, 412*b*, 412*c* for controlling the first through third painting stages 10*a*–10*c*, respectively. The stage master controller 412*a*, which controls the first painting stage 10*a*, is connected to an opening/closing controller 420 for controlling the engine hood opening/closing mechanism 20 and the trunk lid opening/closing mechanism 22, and a painting robot controller 422 and a painting controller 424 for controlling the painting mechanisms 18*a* through 18*d*. The stage master controller 412*b*, which controls the second painting stage 10*b*, is connected to an opening/closing controller 430 for controlling the door opening/closing mechanisms 32*a*, 32*b*, and a painting robot controller 432 and a painting controller 434 for controlling the painting mechanisms 28*a*, 28*b*. The stage master controller 412*c*, which controls the third painting stage 10*c*, is connected to a painting robot controller 442 and a painting controller 444 for controlling the painting mechanisms 36, 38, 40 and the cleaning devices 336, 338, 340.

These stage master controllers 412*a* through 412*c* are coupled to the line master controller 410 and responsive to commands issued therefrom for controlling the painting operation in the respective painting stages 10*a* through 10*c*. The stage master controllers 412*a* through 412*c* also deliver prescribed status information to the line master controller 410. To the line master controller 410, there is also connected a monitor device 414 for monitoring various portions of the painting line. The vehicle body conveyor mechanism 24 is controlled by the line master controller 410 for conveying vehicle bodies 14 to be painted and positioning them in the respective painting stages. Commands are transferred to the stage master controllers 412*a* through 412*c* in synchronism with operation timing of the conveyor mechanism 24.

The line master controller 410 is notified of accidents or other abnormal conditions such as a fire in the painting stages 10*a* through 10*c*, and controls the monitor device 414 to indicate such an accident.

Operation of the painting control system will be described below.

A vehicle body 14 which has been delivered to the first stage 10*a* by the conveyor mechanism 24 is first accessed by the engine hood opening/closing mechanism 20, which opens the engine hood, and by the trunk lid opening/closing mechanism 22, which opens the trunk lid. The engine compartment and the trunk compartment are then painted by the painting mechanisms 18*a* through 18*d* which run along the rails 16*a*, 16*b*. Thereafter, the engine hood and the trunk lid are closed by the respective opening/closing mechanisms 20, 22, and then the vehicle body 14 is conveyed to the second stage 10*b* by the conveyor mechanism 24.

In the second stage 10*b*, the doors of the vehicle body 14 are opened by the door opening/closing mechanisms 32*a*, 32*b*, and the inner surfaces of the opened doors are painted by the painting mechanisms 28*a*, 28*b* which travel along the rails 26*a*, 26*b*. The doors are thereafter closed by the door opening/closing mechanisms 32*a*, 32*b*, and the vehicle body 14 is fed to the third stage 10*c* by the conveyor mechanism 24.

In the third stage 10*c*, the upper, lefthand and righthand side painting mechanisms 36, 38, 40 are positioned in front of the vehicle body 14 which has been delivered from the second stage 10*b*.

When the vehicle body 14 is positioned in the third stage 10*c*, the upper, lefthand and righthand side painting mechanisms 36, 38, 40 run along the rails 34*a*, 34*b* while painting the engine hood, the roof, the trunk lid, and the side panels of the vehicle body 14. The vehicle body 14 which has been painted is then fed by the conveyor mechanism 14 to the fourth stage 10*d* where the vehicle body 14 is dried.

The line master controller 410 controls the operation of the conveyor mechanism 24, and supplies the stage master controllers 412*a* through 412*c* with various items of command information as to a vehicle type and a paint color, for example, in timed relation to the operation of the conveyor mechanism 24 to start delivering the vehicle body 14. In synchronism with the timing when the vehicle body 14 is brought by the conveyor mechanism 24 to the painting stages 10*a* through 10*c*, the stage master controllers 412*a* through 412*c* supply the command information as to the vehicle type, the paint color, and the like to working component controllers such as the opening/closing controllers 420, 430, the painting robot controllers 422, 432, 442, and the painting controllers 424, 434, 444 to indicate the starting of operation of the painting stages 10*a* through 10*c*. The working component controllers then use the command information as keys for effecting a preset operation sequence (processing program) thereby to control the working components. The opening/closing controller 420 opens or closes the engine hood opening/closing mechanism 20 and the trunk lid opening/closing mechanism 22, which are working components, in a prescribed order and at prescribed timing. Similarly, the opening/closing controller 430 opens or closes the door opening/closing mechanism 32*a*, 32*b* in a prescribed order and at prescribed timing.

The painting robot controllers 422, 432, 442 execute the prescribed processing program based on the indicated vehicle type, etc., for controlling the operation of the painting mechanisms 18*a* through 18*d*, 28*a*, 28*b*, 36, 38, 40, and applying painting commands to the painting controllers 424, 434, 444, which responds to the indicated paint color for controlling the rate of discharge of the paint, the rate of discharge of air, and the electrostatic voltage for the painting mechanisms 18*a*–18*d*, 28*a*, 28*b*, 36, 38, 40. When a command is given to change paint colors, the painting controllers effect a cleaning process for the painting mechanisms.

The line master controller 410 receives status signals from the conveyor mechanism 24, the painting stages 10*a* through 10*d*, the stage master controllers 412*a* through 412*c*, the working component controllers (the opening/closing controler 420 and others), and the working components (such as the trunk lid opening/-closing mechanism 20, the painting mechanism 36, and the like), and issues information as to operating and abnormal conditions of the control system to the monitor device 414. Thus, the line master controller 410 monitors the operating condition of the painting line, controls painting conditions, effects failure diagnoses, periodic inspections, and collects or issues production control information.

The painting line according to the present invention is basically arranged and operated as described above. The painting mechanisms in the third stage 10*c*, for example, will be described in greater detail.

Figure 5:
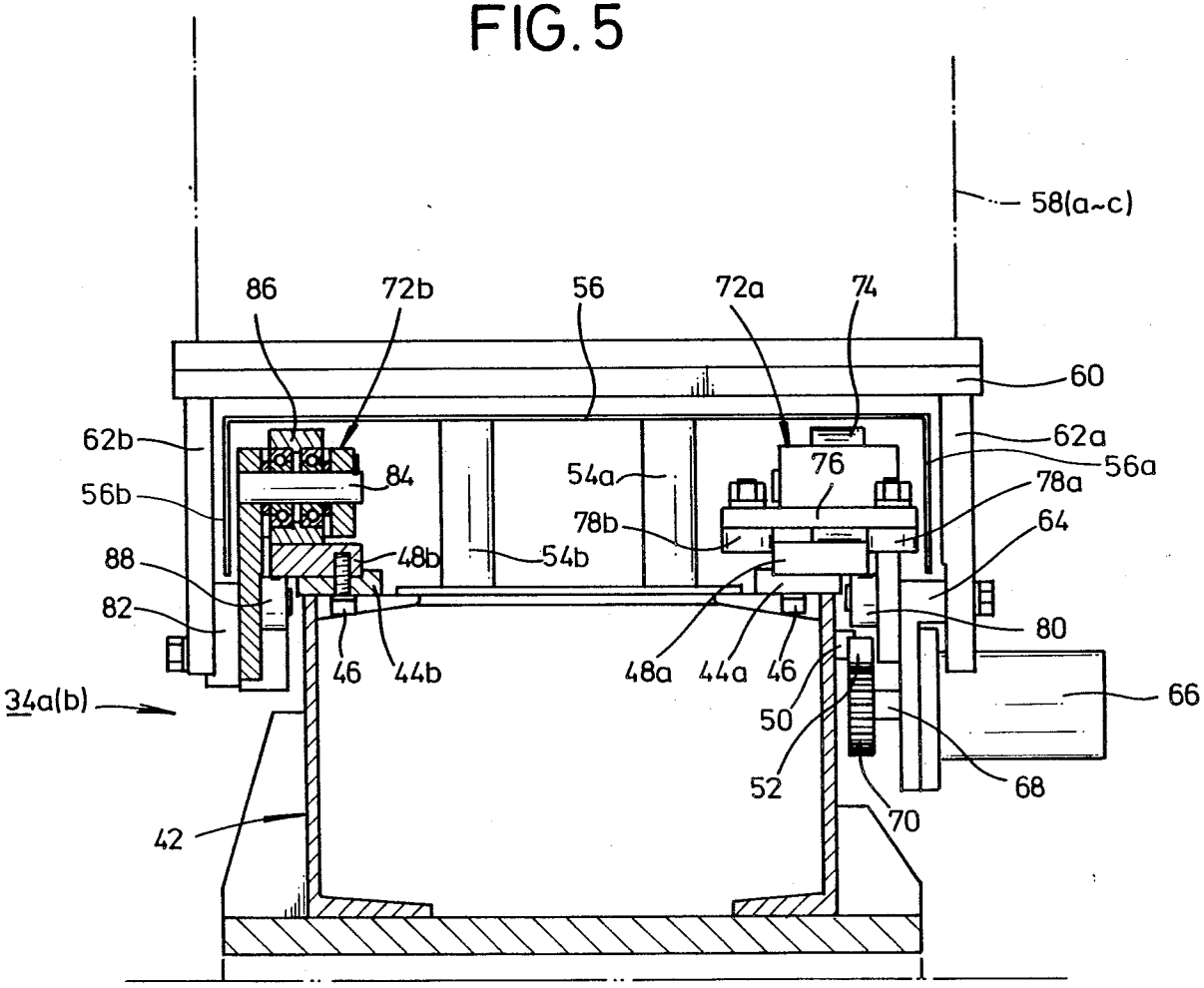
FIG. 5 is a cross-sectional view of a transport means in the painting apparatus.

In the third stage 10*c*, the upper painting mechanism 36, the lefthand side painting mechanism 38, and the righthand side painting mechanism 40 are moved along the rails 34*a*, 34*b* by transport means which are of essentially the same design. More specifically, as shown in FIG. 5, the rails 34*a*, 34*b* are constituted by a rail bracket 42 extending from one end to the other of the rails 34*a*, 34*b*. To the upper surface of the rail bracket 42, there are fixed spacers 44*a*, 44*b* with rails 48*a*, 48*b* secured to their upper surfaces by means of bolts 46. A rack 52 is attached to a vertical outer side of the rail bracket 42 by a support member 50, the rack 52 extending parallel to the rail 48*a*. Two vertical posts 54*a*, 54*b* are mounted on the upper surface of the rail bracket 42, and a protective cover 56 having an inverted channel-shaped cross section is fixed to the upper ends of the posts 54*a*, 54*b*. The protective cover 56 extends along the rails 48*a*, 48*b*. The protective cover 56 has laterally spaced depending legs 56*a*, 56*b* projecting downwardly and spaced from the sides of the rails 48*a*, 48*b* by prescribed gaps.

The upper, lefthand and righthand side painting mechanisms 36, 38, 40 have outer frames comprising casings 58*a* through 58*c* with a plate 60 secured to the lower end thereof. Side plates 62*a*, 62*b* are vertically affixed to the opposite edges of the lower surface of the plate 60. A support member 64 is secured to the lower end of the side plate 62*a*, and a transport motor 66 is fixed to the lower end of the support member 64. The transport motor 66 has a rotatable shaft 68 supporting on its distal end a pinion 70 meshing with the rack 52 fixed to the rail bracket 42.

A roller assembly 72*a* is mounted on the upper end of the support member 64. The roller assembly 72*a* comprises a roller 74 held in rolling engagement with the upper surface of the rail 48*a*, a pair of rollers 78*a*, 78*b* supported on a plate 76 fixed to the roller assembly 72*a* and rollingly held against the opposite sides of the rail 48*a*, and a roller 80 held in rolling contact with the lower surface of the rail 48*a*. Another roller assembly 72*b* is mounted on the side plate 62*a* by a support member 82. The roller assembly 72*b* comprises a roller 86 rotatably supported on a shaft 84 and held in rolling engagement with the upper surface of the rail 48*b*, and a roller 88 held in rolling contact with the lower surface of the rail 48*b*.

Figure 4:
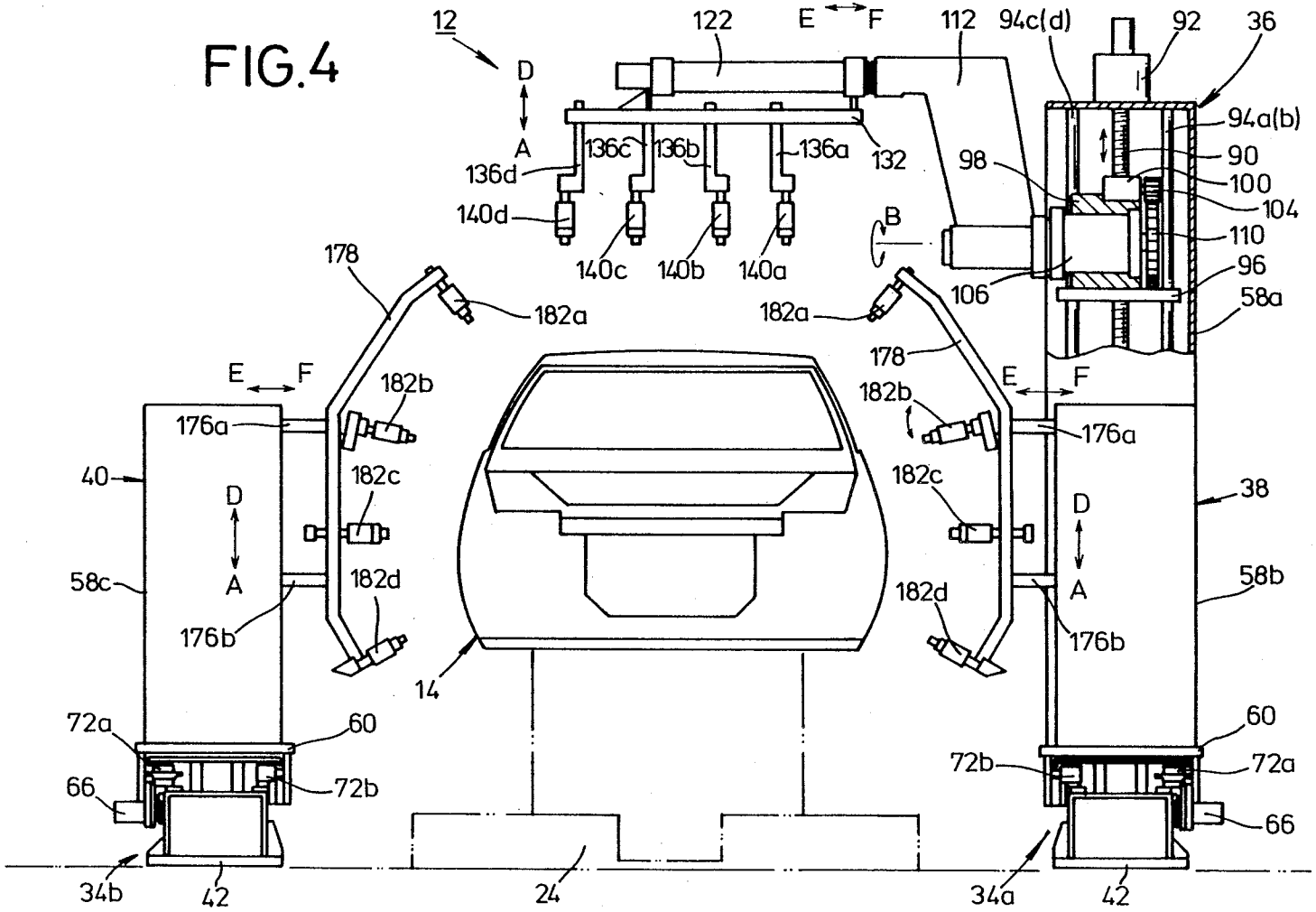
FIG. 4 is front elevational view of the painting apparatus of the present invention.
Figure 6:
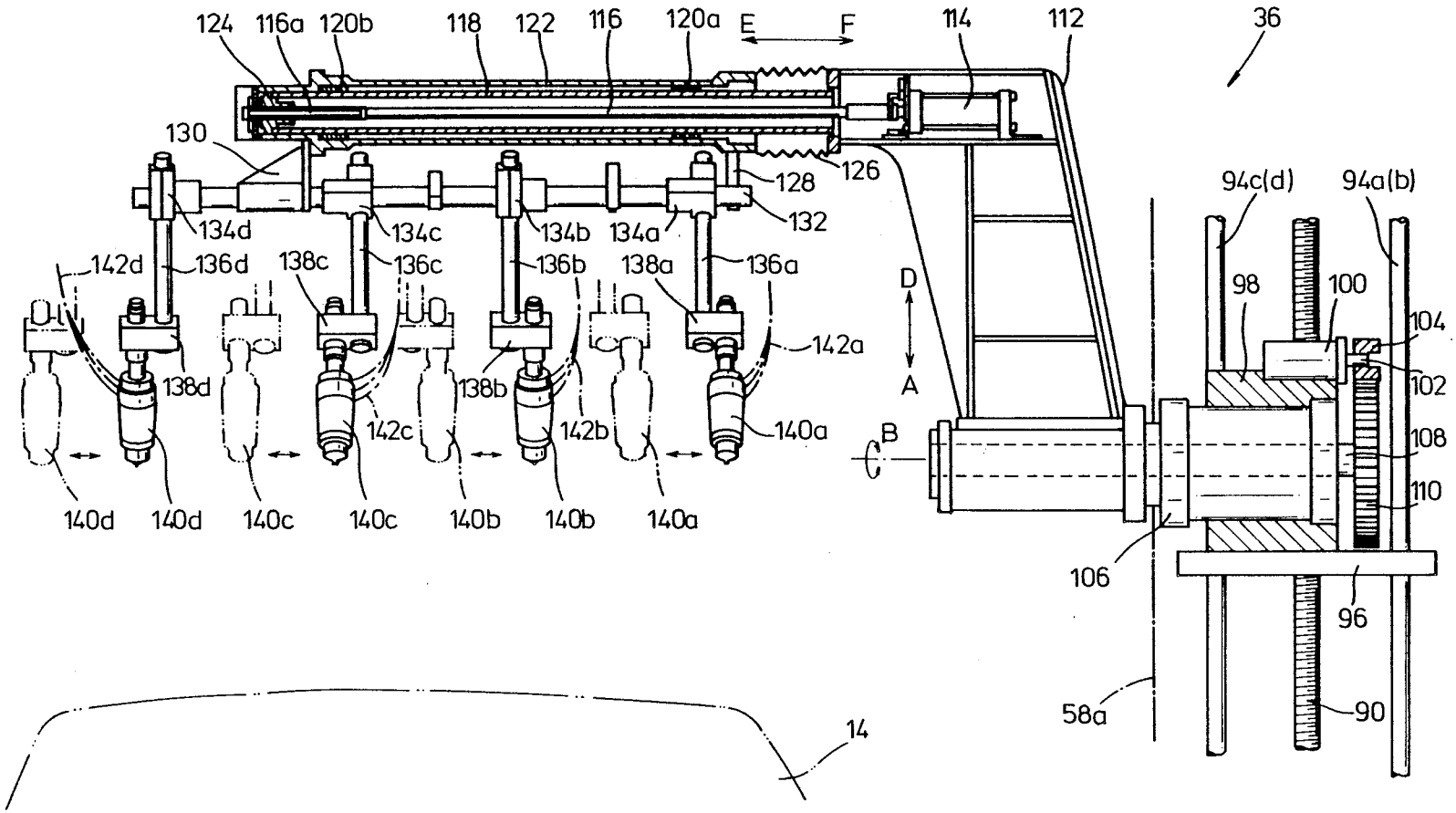
FIG. 6 is an elevational view, partly in cross section, of an upper painting mechanism of the painting apparatus.

The upper painting mechanism 36 will be described below. As shown in FIGS. 4 and 6, a vertical ball screw 90 is rotatably supported in the casing 58*a* and has an upper end coupled to the drive shaft of a lifting/lowering motor 92 mounted on the upper surface of the casing 58*a* as a painting distance adjusting means. Four guide rods 94*a* through 94*d* are disposed vertically parallel to each other around the ball screw 90. A horizontal support plate 96 is threadedly disposed around and held in mesh with the ball screw 90 and can be moved upwardly and downwardly by rotating the ball screw 90 about its own axis upon energization of the lifting/-lowering motor 92. The guide rods 94*a*–94*d* extend through the support plate 96.

As shown in FIG. 6, a turning motor 100 is fixed to the upper surface of the support plate 96 via a holder 98. The turning motor 100 has a rotatable shaft 102 on which a gear 104 is mounted. The holder 98 holds therein a bearing 106 supporting a turning shaft 108 having one end on which is mounted a gear 110 meshing with the gear 104. The other end of the turning shaft 108 projects out of he casing 58*a*, and one end of a swing arm 112 is secured to the projecting end of the turning shaft 108.

A shifting cylinder 114 is disposed as a shifting means on the other end of the swing arm 112. The shifting cylinder 114 has a piston rod 116 extending horizontally in transverse relation to the rails 34*a*, 34*b*. A fixed shaft 118 having one end secured to the swing arm 112 is disposed loosely around the piston rod 116. A cylindrical slide sleeve 122 is slidably fitted over the fixed shaft 118 through slide bearings 120*a*, 120*b* interposed therebetween. Splines 116*a* are formed on the distal end of the piston rod 116. A guide member 124 fixed to the other end of the fixed shaft 118 is slidably fitted over the splines 116*a*. One end of the splines 116*a* are affixed to one end of the slide sleeve 122. Between the other end of the slide sleeve 122 and the swing arm 112, there is mounted an expandable and contractable bellows-like cover member 126 for preventing paint deposits from being applied to the fixed shaft 118.

A horizontal gun arm 132 is coupled to the outer periphery of the slide sleeve 122 through support members 128, 130. Clamp members 134*a* through 134*d* are fastened to the horizontal gun arm 132 in spaced relation to each other. Gun support bars 136*a* through 136*d* are held by the clamp members 134*a* through 134*d*, respectively, perpendicularly to the horizontal gun arm 132. Paint spray guns 140*a* through 140*d* are secured as paint spraying means respectively to the lower ends of the gun support bars 136*a* through 136*d* via respectively joints 138*a* through 138*d*, the paint spray guns 140*a* through 140*d* being spaced from each other. Paint conduit cables 142*a* through 142*d* are connected to the paint spray guns 140*a* through 140*d* for supplying paint to the associated paint spray guns.

Figure 7:
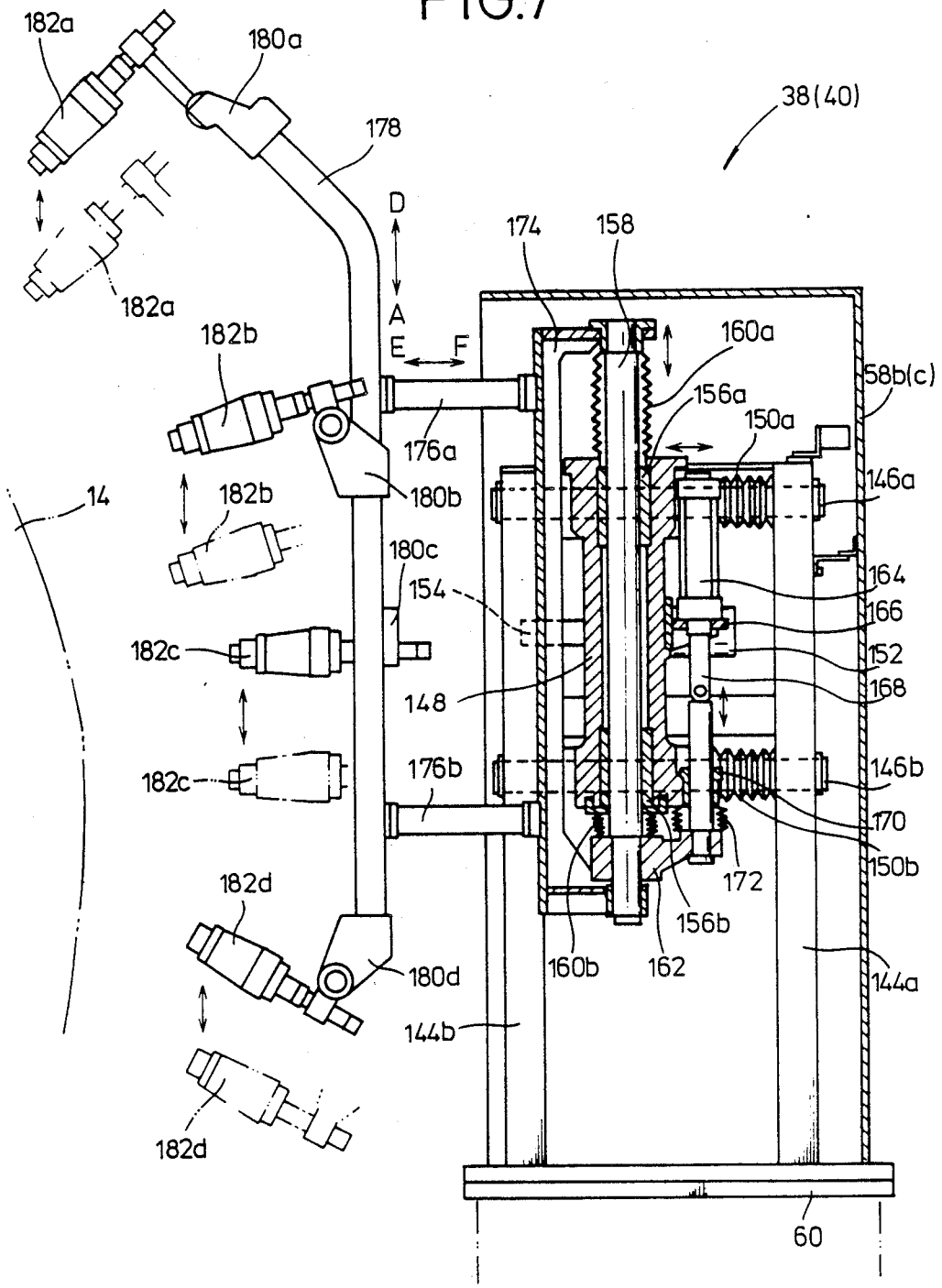
FIG. 7 is an elevational view, partly in cross section, of a side painting mechanism of the painting apparatus.

The lefthand and righthand side painting mechanisms 38, 40 serve to paint the lefthand and righthand sides, respectively, of the vehicle body 14, and are of basically the same construction. As illustrated in FIGS. 4 and 7, vertical posts 144*a*, 144*b* are disposed in each of the casings 58*b*, 58*c* of the lefthand and righthand side painting mechanisms 38, 40. Two guide bars 146*a*, 146*b* extend horizontally between and are connected to the posts 144*a*, 144*b* in perpendicular relation to the rails 34*a*, 34*b*, and a holder 148 is slidably mounted on the guide bars 146*a*, 146*b*. Expandable and contractable cover members 150*a*, 150*b* are disposed around the guide bars 146*a*, 146*b* between the holder 148 and the post 144*a*. A horizontally moving cylinder 152 is fixed to the holder 148 and has a piston rod (not shown) with its distal end connected to the post 144*b* through a joint 154.

A shifting guide bar 158 extends vertically through and is slidably supported in the holder 148 by means of slide bearings 156*a*, 156*b*. Expandable and contractable cover members 160*a*, 160*b* are disposed around the upper and lower end portions of the shifting guide bar 158 which project from the holder 148. A joint 162 is attached to the lower end of the shifting guide bar 158. A shifting cylinder 164 is fixed as a shifting means to the outer periphery of the holder 148 through a support member 166, and has a downwardly extending piston rod 168 coupled to the joint 162 through a guide member 170 affixed to the holder 148. An expandable and contractable cover member 172 is disposed around the piston rod 168 between the guide member 170 and the joint 162.

A holder 174 is coupled to the shifting guide bar 158 at its upper and lower ends. A gun arm 178 is supported on the holder 174 through support members 176*a*, 176*b*. To the gun arm 178, there are attached paint spray guns 182*a* through 182*d* as paint spraying means by means of joints 180*a* through 180*d*, respectively, the paint spray guns 182*a* through 182*d* are spaced from each other. The paint spray guns 182*a* through 182*d* are positioned in a vertical pattern which is shaped complementarily to a side panel of the vehicle body 14.

Figure 8:
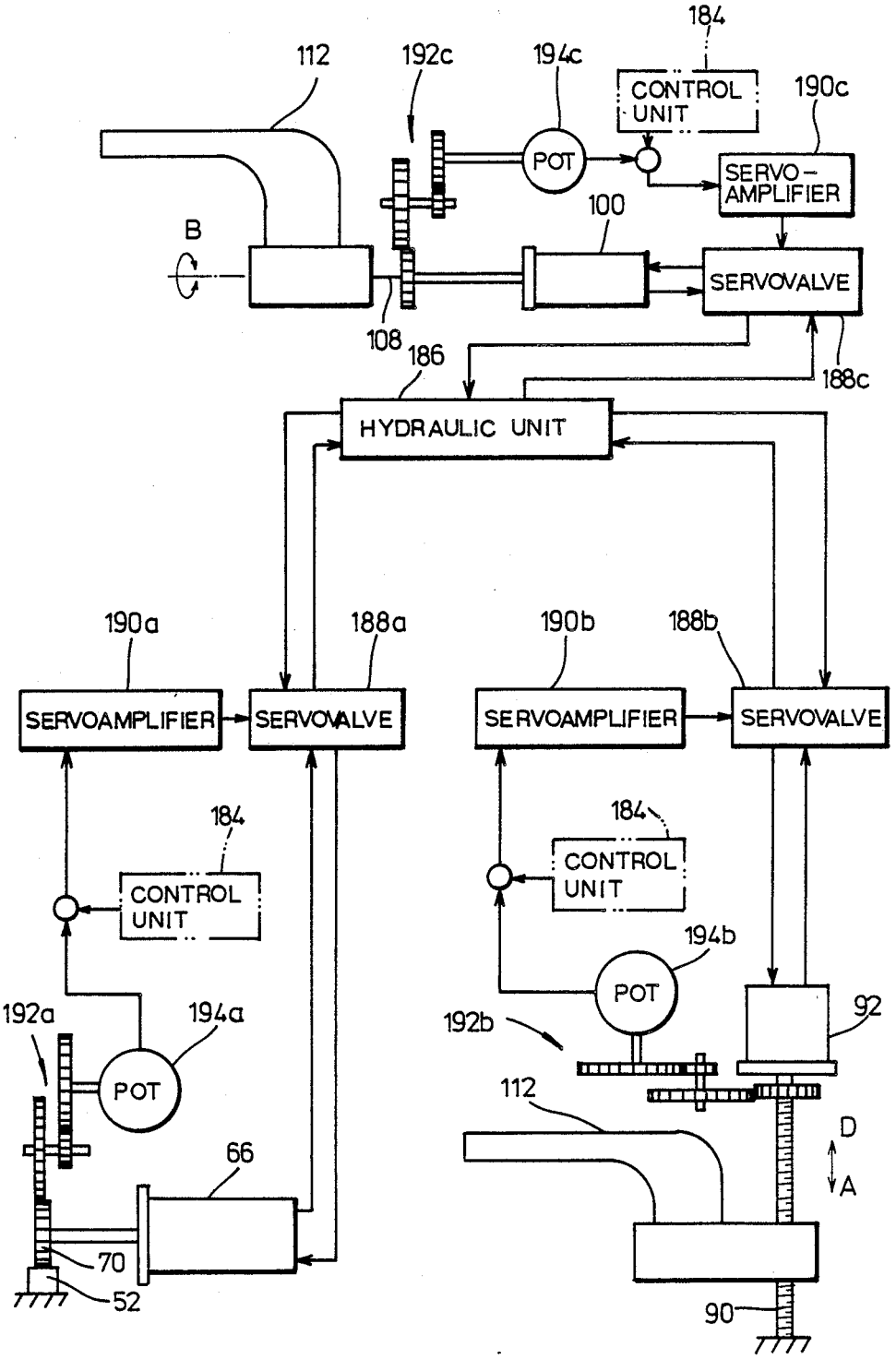
FIG. 8 is a block diagram of a drive control system for the upper painting mechanism.

The painting apparatus thus constructed is operated by a drive control system which is arranged as shown in FIG. 8.

As shown in FIG. 8, a control unit 184 issues a control signal which has previously been established as by a teaching process, for controlling operation of the upper painting mechanism 36. The upper painting mechanism 36 is driven by a hydraulic servo system comprising a hydraulic unit 186 in the form of a fluid pressure pump or the like, servovalves 188*a* through 188*c*, servoamplifiers 190*a* through 190*c* responsive to the control signal from the control unit 184 for driving the servovalves 188*a* through 188*c*, and a hydraulic motor.

The hydraulic motor comprises the transport motor 66 for moving the upper painting mechanism 36 along the rail 34*a*, the lifting/lowering motor 92 for moving the swing arm 112 with the paint spray guns 140*a* through 140*d* in a vertical direction, and the turning motor 100 for turning the swing arm 122 around the turning shaft 108. The rotational speed of the transport motor 66 is detected by a potentiometer 194*a* through a speed reducer 192*a* and fed as a positional signal indicative of the position of the upper painting mechanism 36 with respect to the rail 34*a* back to the servoamplifier 190*a*. Similarly, the rotational speed of the lifting/lowering motor 92 is detected by a potentiometer 194*b* through a speed reducer 192*b* and fed as a positional signal indicative of the position of the swing arm 112 with respect to the vertical direction back to the servoamplifier 190*b*. The rotational speed of the turning motor 100 is detected by a potentiometer 194*c* through a speed reducer 192*c* and fed as a tilt signal back to the servoamplifier 190*c* at the time the swing arm 112 is tilted around the swing arm 108.

Figure 9:
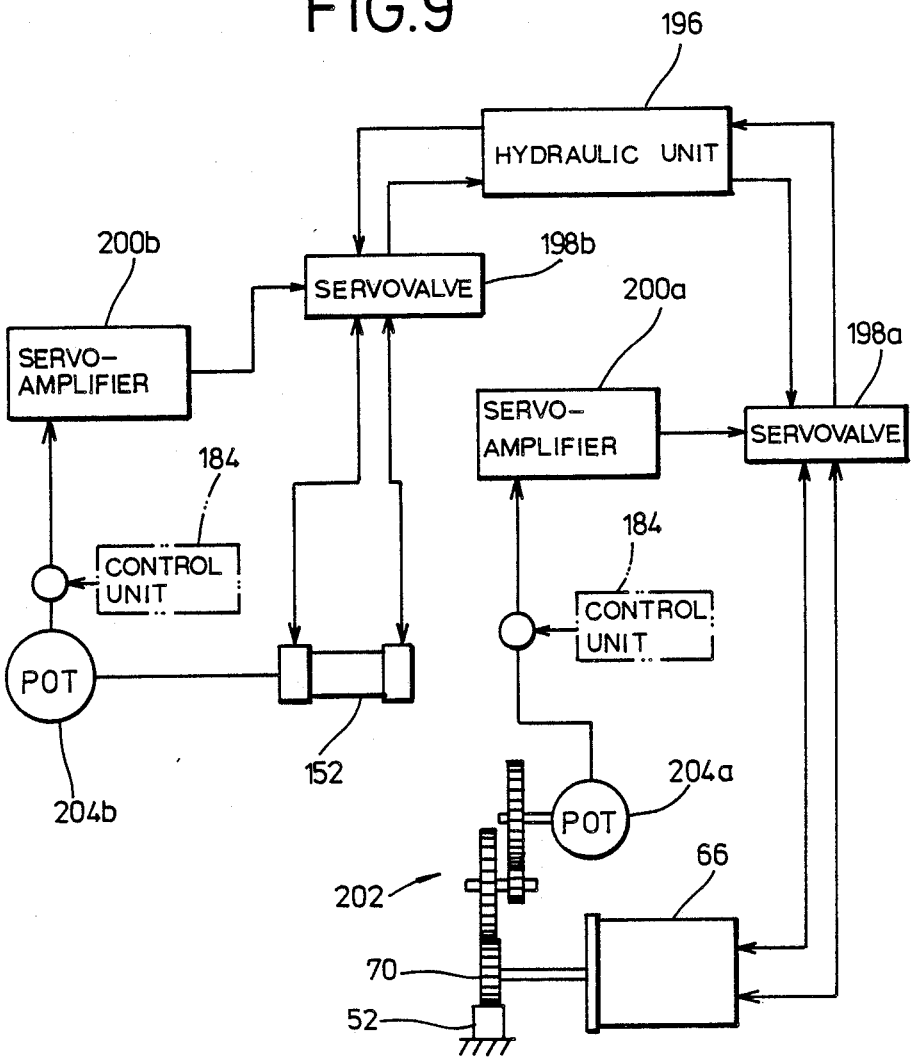
FIG. 9 is a block diagram of a drive control system for the side painting mechanism.

As shown in FIG. 9, the lefthand and righthand side painting mechanisms 38, 40 are driven by a hydraulic servo system comprising a hydraulic unit 196, servovalves 198*a*, 198*b*, servoamplifiers 200*a*, 200*b*, a hydraulic motor, and a hydraulic cylinder. The hydraulic servo system is also controlled by the control unit 184 which is shared by the drive control system for the upper painting mechanism 36. The rotational speed of the transport motor 66 as the hydraulic motor is detected by a potentiometer 204*a* through a speed reducer 202 and fed as a positional signal indicative of the position of the lefthand and righthand side painting mechanisms 38, 40 with respect to the rails 34*a*, 34*b* back to the servoamplifier 200*a*. The amount of displacement of the horizontally moving cylinder 152 as the hydraulic cylinder is detected by a potentiometer 204*b* and fed as a positional signal indicative of the position of the paint spray guns 182*a* through 182*d* with respect to the vehicle body 14 back to the servoamplifier 200*b*.

The cleaning devices 336, 338, 400 will hereinafter be described.

Figure 11:
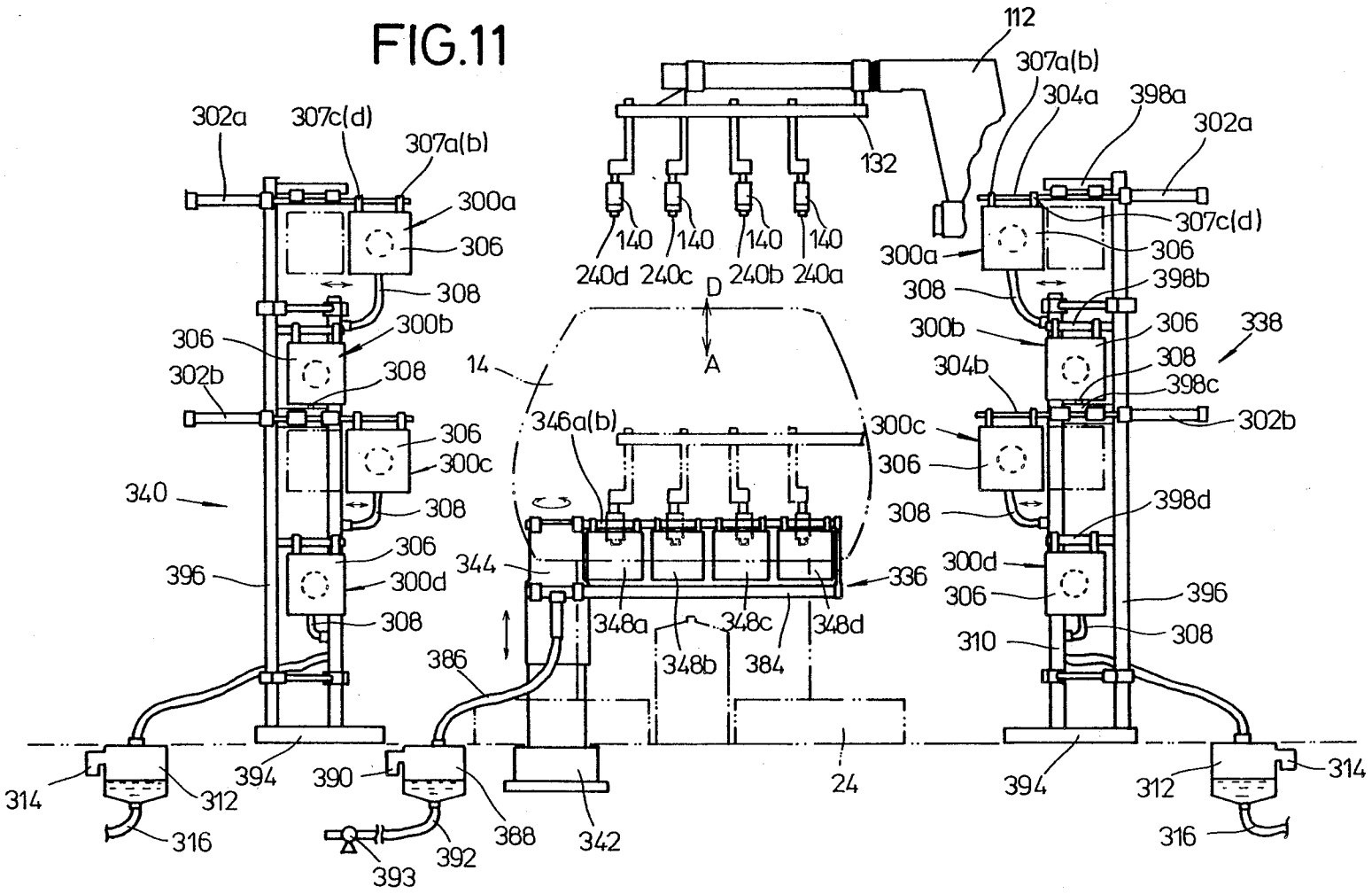
FIG. 11 is a fragmentary side elevational view of a cleaning device according to the present invention.

As illustrated in FIG. 11, the cleaning device or upper painting gun cleaning mechanism 336 includes a base 342 and a body 344 vertically movably and swingably mounted on the base 342. Support rods 346*a*, 346*b* have one ends attached to an upper portion of the body 344 and extend horizontally parallel to each other. The support rods 346*a*, 346*b* support thereon cleaning tanks 348*a* through 348*d* which are spaced from each other in vertical alignment with the paint spray guns 140*a* through 140*d*, respectively, of the upper painting mechanism 36.

Since the cleaning tanks 348*a* through 348*d* are of the same construction, only the cleaning tank 348*a* will be described below in detail and the other cleaning tanks 348*b* through 348*d* will not be described.

Figure 12:
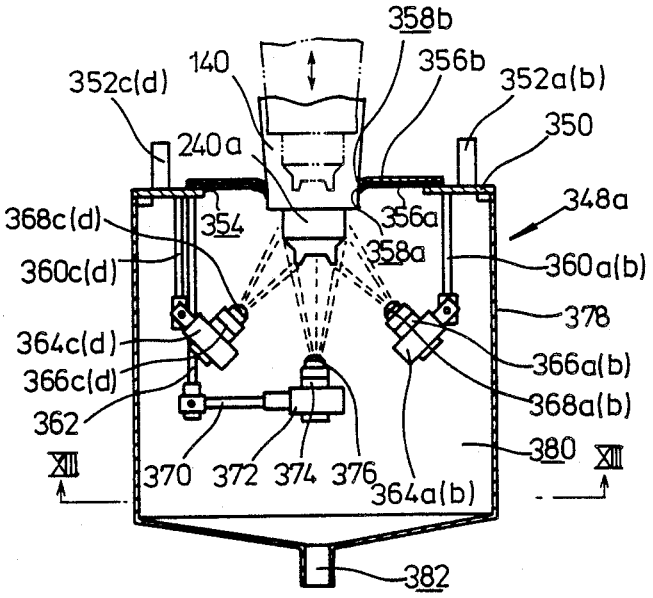
FIG. 12 is a vertical cross-sectional view of a cleaning tank of the cleaning device.

As shown in FIG. 12, the cleaning tank 348*a* has a base plate 350 having support members 352*a* through 352*b* engaging the support rods 346*a*, 346*b* from which the cleaning tank 348*a* is suspended. The base plate 350 has a relatively large circular opening 354 defined centrally therein. Flexible cover members 356*a*, 356*b* are fixed to the base plate 350 over the opening 354. The cover members 356*a*, 356*b* are of the same shape and have central holes 358*a*, 358*b*, respectively, which are of a diameter smaller than that of nozzles 240*a* through 240*d* of the paint spray guns 140*a* through 140*d*. The cover members 356a, 356b have slits (not shown) extending radially outwardly from the centers of the holes 358a, 358b and spaced from each other. The flexible cover members 356a, 356b are placed one on the other and fixed to the base plate 350 with the slits not overlapping each other.

Figure 13:
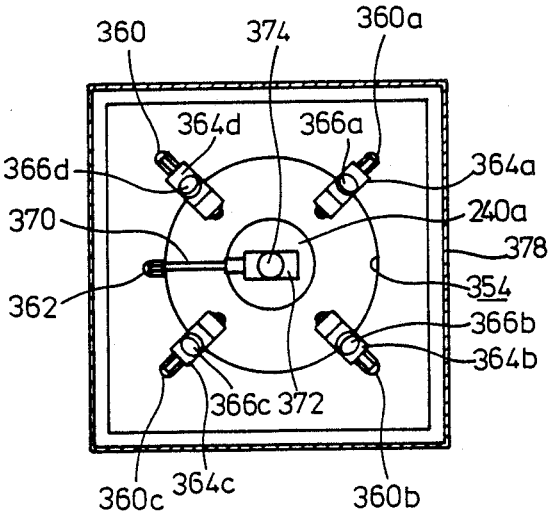
FIG. 13 is a cross-sectional view taken along line XIII—XIII of FIG. 12.

As shown in FIG. 13, support bars 360a through 360d each have one end secured to the surface of the base plate 350 remote from the support members 352a through 352d, the support bars 360a through 360d surrounding the opening 354 and being equidistantly spaced from each other. Another support bar 362 has one end secured to the base plate 350 between the support bars 360c, 360d. Holders 364a through 364d are each attached to the other end of the support bars 360a through 360d, respectively, and cleaning guns 366a through 366d are mounted respectively on the holders 364a through 364d. The cleaning guns 366a through 366d have nozzle ends 368a through 368d inclined toward the base plate 350 and directed to the central axis of the opening 354. A support bar 370 is perpendicularly coupled to the other end of the support bar 362, and a holder 372 is mounted on the support bar 370. A cleaning gun 374 is mounted on the holder 372 and has a nozzle end 376 directed toward the opening 354 in alignment with the central axis thereof.

A casing 378 is detachably mounted on the base plate 350 by means of bolts, for example, defining a cleaning chamber 380 therein. The cleaning chamber 380 is held in communication, through the lower end of the casing 378, with a small-diameter drain/mist outlet 382.

In FIG. 11, a conduit 384 is connected to the outlets 382 of the cleaning tanks 348a through 348d, and attached to the body 344 for vertical and turning movement in unison therewith. To the conduit 384, there is connected one end of a flexible conduit 386 with its other end coupled to a separation tank 388. The separation tank 388 has a mist conduit 390 on its upper portion and is connected at its lower portion to a drain conduit 392 which is connected to a pump 393, for example, that is coupled to a drain processing unit (not shown).

The other cleaning devices or side paint spray gun cleaning mechanisms 338, 340 are structurally identical to each other. Therefore, only the side paint spray gun cleaning mechanism 338 will be described below in detail.

The cleaning mechanism 338 includes a base 394 on which a post 396 is vertically mounted. The post 396 has holders 398a through 398d extending horizontally at different heights. Cleaning tanks 300a through 300d are supported on the holders 398a through 398d, respectively, in horizontal alignment with the respective paint spray guns 182a through 182d of the lefthand side painting mechanism 38. The cleaning tanks 300b, 300d are fixed to the holders 398b, 398d, respectively, whereas the other cleaning tanks 300a, 300c are horizontally diplaceable. More specifically, cleaning tank shifting cylinders 302a, 302b are horizontally mounted on the post 396 in vertically spaced relation to each other, and have respective piston rods 304a, 304b extending horizontally and coupled to the cleaning tanks 300a, 300c, respectively.

The cleaning tanks 300a through 300d are structurally substantially the same as the cleaning tank 348a. The cleaning tanks 300a through 300d have casings 306 on which there are mounted support members 307a through 307d by which the cleaning tanks 300a through 300d are suspended from the holders 398a, 398d and the piston rods 304a, 304b. The internal structures of the cleaning tanks 300a through 300d are the same as that of the cleaning tank 348a, and hence will not be described in detail.

The casings 306 of the cleaning tanks 300a through 300d are connected at their lower ends to drain/mist conduits 308 that are coupled via a conduit 310 to a separation tank 312 which has a mist conduit 314 and is joined to a drain conduit 316.

The detailed construction of the third painting stage 10c is as described above. Operation of the third painting stage 10c is as follows:

In the third painting stage 10c, the upper painting mechanism 36, the lefthand side painting mechanism 38, and the righthand side painting mechanism 40 are positioned in front of the vehicle body 14 in a waiting condition. On the upper painting mechanism 36, the lifting/-lowering motor 92 is operated to rotate the ball screw 90 to lower the swing arm 112 from the position of FIG. 4 in the direction of the arrow A. At the same time, the turning motor 100 is operated to turn the swing arm 112 about the turning shaft 108 in the direction of the arrow B. The paint spray guns 140a through 140d mounted by the slide sleeve 122 on the end portion of the swing arm 112 are now oriented toward the front head of the vehicle 14, as shown in FIG. 3.

Figure 10:
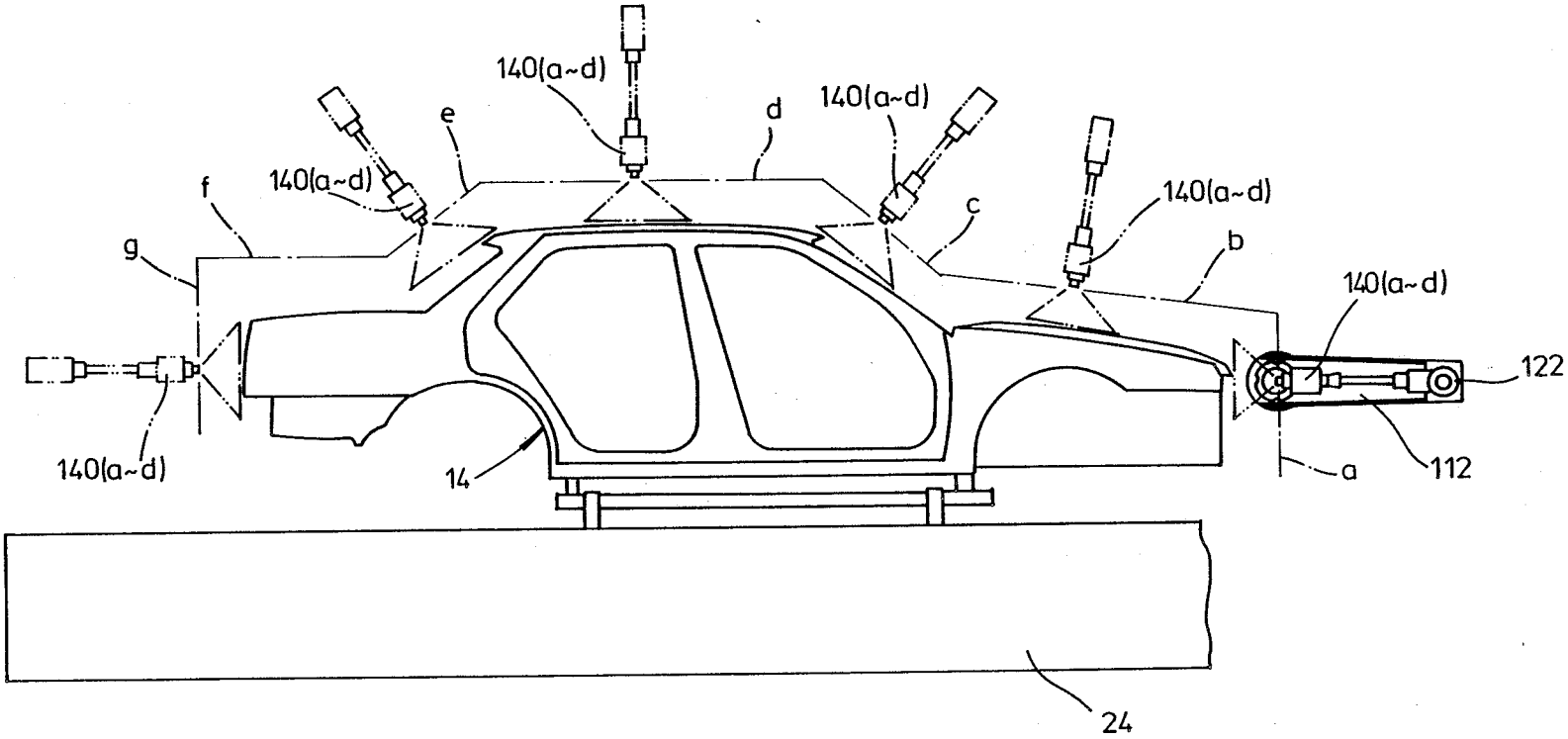
FIG. 10 is a side elevational view showing the manner in which an upper vehicle body portion is painted by the upper painting mechanism.

A painting process effected by the upper painting mechanism 36 will be described with reference to FIGS. 4, 8 and 10. When a control signal is issued from the control unit 184, the servoamplifier 190a is controlled by the control signal to operate the servovalve 188a. A fluid under pressure supplied from the hydraulic unit 186 is delivered through the servovalve 188a to drive the transport motor 66. As a result, the pinion 70 mounted on the rotatable shaft 68 of the transport motor 66 is rotated to cause the upper painting mechanism 36 to start running with the roller assemblies 72a, 72b along the rails 48a, 48b in the direction of the arrow C.

The rotational speed of the transport motor 66, i.e., the amount of movement of the upper painting mechanism 36, is detected by the potentiometer 194a through the speed reducer 192a. When the spacing between the front end of the vehicle body 14 and the paint spray guns 140a through 140d of the upper painting mechanism 36 reaches a prescribed distance, the potentiometer 194a applies a positional signal to the servoamplifier 190a which then controls the transport motor 66 through the servovalve 188a. As a consequence, the distance between the front end of the vehicle body 14 and the paint spray guns 140a through 140d is kept constant.

Then, the servoamplifier 190b operates the servovalve 188b based on a control signal from the control unit 184, for enabling the fluid under pressure from the hydraulic unit 186 to drive the lifting/lowering motor 92 through the servovalve 188b. Consequently, the ball screw 90 coupled to the motor 92 is rotated to cause the support plate 96 meshing with the ball screw 90 to start lifting the swing arm 112 in the direction of the arrow D. Paint sprays are ejected from the paint spray guns 140a through 140d toward the front end of the vehicle body 14 to paint the front end along a paint line a (FIG. 10).

The paint spray guns 140a through 140d are spaced at intervals so as to prevent the ejected paint sprays from interfering with each other. Therefore, the surface of the front end of the vehicle body 14 is coated with spaced strips of paint as shown in FIG. 3.

After the front end has been painted and when the paint spray guns 140*a* through 140*d* reach the boundary between the front end and the engine hood, the servoamplifier 190*c* operates the servovalve 188*c* in response to a control signal from the control unit 184 for enabling the fluid under pressure from the hydraulic unit 186 to drive the turning motor 100 through the servovalve 188*c*. As a consequence, the swing arm 112 is turned about the turning shaft 108 in the direction of the arrow B by the gear 110 meshing with the gear 104 mounted on the shaft 102 of the motor 100. The paint spray guns 140*a* through 140*d* coupled by the slide sleeve 122 to the swing arm 112 are now directed perpendicularly to the engine hood of the vehicle body 14.

The angular displacement of the swing arm 112 is detected by the potentiometer 194*c* through the speed reducer 192*c*. When the paint spray guns 140*a* through 140*d* are directed perpendicularly to the engine hood, the potentiometer 194*c* applies a prescribed tilt signal to the servoamplifier 190*c*, which controls the turning motor 100 through the servovalve 188*c*. The paint spray guns 140*a* through 140*d* are now held perpendicularly to the engine hood of the vehicle body 14.

Then, the upper painting mechanism 36 is driven by the transport motor 66 along the rail 34*a* for painting the engine hood along a painting line b. The vertical position of the swing arm 112 is detected by the potentiometer 194*b* which detects the rotational speed of the lifting/lowering motor 92. The potentiometer 194*b* applies a positional signal to the servoamplifier 190*b* to enable the latter to control the lifting/lowering motor 92 through the servovalve 188*b*. Thus, the swing arm 112 is elevated in the direction of the arrow D as the upper painting mechanism 36 advances in the direction of the arrow C, so that a paint coating of uniform thickness can be applied to the engine hood while the engine hood and the paint spray guns 140*a* through 140*d* remain spaced a constant distance from each other.

Similarly, while the paint spray guns 140*a* through 140*d* are being spaced uniformly from the surface of the vehicle body 14 and directed perpendicularly to the vehicle body surface, strips of paint are coated on the vehicle body surface as the upper painting mechanism 36 moves along painting lines c, d, e and f. Finally, the turning motor 100 is driven to hold the paint spray guns 140*a* through 140*d* facing perpendicularly to the rear end of the vehicle body 14. Then, while the lifting/lowering motor 92 is being driven to lower the paint spray guns 140*a* through 140*d* in the direction of the arrow A, the rear end of the vehicle body 14 is coated along a painting line g.

The lateral sides of the vehicle body 14 are painted by the lefthand and righthand side painting mechanisms 38, 40 as follows:

When a control signal is issued from the control unit 184, the servoamplifier 200*a* (FIG. 9) actuates the servovalve 198*a* to enable a fluid under pressure from the hydraulic unit 196 to drive the transport motor 66 through the servovalve 198*a*. As a result, the lefthand and righthand side painting mechanisms 38, 40 run along the rails 34*a*, 34*b* in the direction of the arrow C (FIG. 3), while paint sprays are discharged from the paint spray guns 182*a* through 182*d* to coat the lateral sides of the vehicle body 14. The paint spray guns 182*a* through 182*d* are spaced a prescribed distance from the vehicle body 14, so that strips of paint are coated on the vehicle body sides without interfering with each other.

The amount of displacement of the lefthand and righthand side painting mechanisms 38, 40 in the direction of the arrow C is detected by the potentiometer 204*a* through the speed reducer 202. The distance between each of the sides of the vehicle body 14 and the paint spray guns 182*a* through 182*d* is controlled by the horizontally moving cylinder 152. More specifically, when a control signal is generated by the control unit 184, the servoamplifier 200*b* operates the servovalve 184*b* to enable the latter to apply a fluid under pressure for driving the cylinder 152. Therefore, the paint spray guns 182*a* through 182*d* coupled by the gun arm 178 to the holder 174 are moved in the direction of the arrow E or F (FIG. 7). The amount of movement of the paint spray guns 182*a* through 182*d* is detected by the potentiometer 204*b*, which then applies a prescribed positional signal to the servoamplifier 200*b* that controls the cylinder 152 through the servovalve 198*b*. Consequently, the paint spray guns 182*a* through 182*d* are displaced in the direction of the arrow E or F as the lefthand and righthand side painting mechanisms 38, 40 move in the direction of the arrow C for thereby keeping the side of the vehicle body 14 and the paint spray guns 182*a* through 182*d* spaced a constant distance. Therefore, a paint coat of uniform thickness can be applied to the sides of the vehicle body 14.

The lefthand and righthand side painting mechanisms 38, 40 are moved while they are being spaced a given distance from the upper painting mechanism 36. Specifically, as shown in FIG. 3, the paint spray gun 140*a* (FIG. 4) of the upper painting mechanism 36 and the paint spray gun 182*a* of the lefthand side painting mechanism 48 are spaced a distance from each other at all times, whereas the paint spray gun 140*d* of the upper painting mechanism 36 and the paint spray gun 182*a* of the righthand side painting mechanism 48 are spaced a distance from each other at all times. By moving the painting mechanisms 36, 38, 40 while keeping them thus spaced from each other, paint sprays ejected from those paint spray guns which are located most closely to each other are prevented from interfering with each other. Therefore, the paint coating on the vehicle body 14 is free from coating irregularities or paint runs and sags which would otherwise result from interference of paint sprays.

The vehicle body 14 is thus coated with strips of paint as indicated by the shaded areas in FIG. 3. The painting mechanisms 36, 38, 40 are moved to the position indicated by the two-dot-and-dash lines in FIG. 3.

Then, the shifting cylinder 164 associated with each of the lefthand and righthand side painting mechanisms 38, 40 is driven. The piston rod 168 of the shifting cylinder 164 is lowered to cause the joint 162 to move the guide bar 158 downwardly in the direction of the arrow A (FIG. 7). As a consequence, the paint spray guns 182*a* through 182*d* are shifted to the two-dot-and-dash-line position in FIG. 7 by the holder 174 supported on the guide bar 158.

Thereafter, the servoamplifier 200*a* responds to a control signal from the control unit 184 to operate the servovalve 198*a* for thereby driving the transport motor 66 with a fluid under pressure from the hydraulic unit 196. The lefthand and righthand side painting mechanisms 38, 40 run along the lateral sides of the vehicle body 14 in the direction of the arrow G while coating the unpainted areas or strips on the vehicle body sides with paint sprays ejected from the paint spray guns 182*a* through 182*d*. The painting mechanisms 38, 40 return to the solid-line position shown in FIG. 3, whereupon they are stopped.

On the upper painting mechanism 36, the shifting cylinder 114 (FIG. 6) in the swing arm 112 is driven to displace the piston rod 116 thereof in the direction of the arrow E. Since the end of the piston rod 116 is coupled to the slide sleeve 122, the slide sleeve 122 is displaced therewith along the fixed shaft 118 disposed around the piston rod 116. Thus, the paint spray guns 140*a* through 140*d* coupled to the slide sleeve 122 by the horizontal gun arm 132 are shifted to the two-dot-and-dash-line position shown in FIG. 6.

Then, the transport motor 66, the lifting/lowering motor 92, and the turning motor 100 are driven to move the upper painting mechanism 36 along the rail 34*a* in the direction of the arrow G (FIG. 3). The unpainted areas or strips on the upper vehicle body surface are coated by the paint spray guns 140*a* through 140*d* as they are displaced back along the painting lines g through a until the upper painting mechanism 36 returns to the solid-line position of FIG. 3, whereupon it is put to a stop. At this time, too, the lefthand and righthand side painting mechanisms 38, 40 and the upper painting mechanism 36 are spaced from each other to avoid mutual interference of paint sprays discharged therefrom.

After the painting process as above is finished, the vehicle body 14 is transferred by the conveyor mechanism 24 to the fourth stage 10*d* where the vehicle body 14 is dried.

In the above embodiment, to prevent the paint sprays from interfering with each other, the vehicle body 14 is coated in a strip-shaped pattern while the paint spray guns 140*a* through 140*d* are being spaced from each other and also the paint spray guns 182*a* through 182*d* are being spaced from each other while coating the vehicle body 14, and thereafter the paint spray guns 140*a* through 140*d* and the paint spray guns 182*a* through 182*d* are shifted by the shifting cylinders 114, 164 before the unpainted areas of the vehicle body 14 are painted. However, as a modification, the paint spray guns 140*a* through 140*d* and 182*a* through 182*d* may be disposed as two groups in both solid-line and two-dot-dash-line positions shown in FIGS. 6 and 7, and such two groups of paint spray guns may be spaced from each other in the direction in which the painting mechanisms 36, 38, 40. With such an alternative, the entire surface of the vehicle body 14 can be painted in one coating operation.

When changing paint colors in order to paint a different vehicle type, the paint spray guns 140*a* through 140*d* and 182*a* through 182*d* are cleaned by the cleaning devices 336, 338, 340 after a vehicle body 14 has been painted or before it is painted on the painting line 10.

More specifically, as shown in FIG. 1, the upper paint spray gun cleaning device 336 is directed parallel to the rail 34*b* while vehicle bodies 14 are being painted, so that the cleaning device 336 will not obstruct the vehicle body 14 as it is painted. For cleaning the paint spray guns 140*a* through 140*d*, the body 344 (FIG. 11) is displaced vertically upwardly, and thereafter the body 344 is horizontally turned by a non-illustrated drive source until the rods 346*a*, 346*b* are positioned parallel to the horizontal gun arm 132, for thereby moving the cleaning tanks 348*a* through 348*d* to their prescribed position.

Then, the lifting/lowering motor 92 is driven to cause the ball screw 90 to displace the support plate 96 in the direction of the arrow A (FIG. 6). The paint spray guns 140*a* through 140*d* are also displaced in the direction of the arrow A by the swing arm 112 supported by the support plate 96. At this time, as shown in FIG. 12, the nozzle 240*a* of the paint spray gun 140*a* enters the holes 358*a*, 358*b* of the flexible covers 356*a*, 356*b* attached to the base plate 350 of the cleaning tank 348*a*. Since the holes 358*a*, 358*b* are smaller in diameter than the nozzle 240*a* and the slits (not shown) of the covers 356*a*, 356*b* which communicate with the holes 358*a*, 358*b* do not overlap each other, the upper end of the chamber 380 in the casing 378 can fully be closed by the nozzle 240*a*.

A solvent such as a thinner or a mixture of the solvent and air is ejected from the nozzle ends 368*a* through 368*d* and 376 through conduits coupled to the cleaning guns 366*a* through 366*d* and 374. As the nozzle ends 368*a* through 368*d* and 376 are directed toward the central axis of the opening 354, i.e., the nozzle 240*a* of the paint spray gun 140*a*, the solvent or the mixture from the nozzle ends 368*a* through 368*d* and 376 is forcibly applied against the nozzle 240*a* for effectively cleaning the same.

The upper end of the chamber 380 where the nozzle 240*a* enters is closed by the flexible covers 356*a*, 356*b*. Thus, the solvent or the mixture discharged from the cleaning guns 366*a* through 366*d* and 374 is prevented from leaking out of the cleaning tank 348*a*. As a result, any mist containing a large amount of thinner will not go into the working space and hence will not adversely affect the health of the workers.

While the nozzle 240*a* of the paint spray gun 140*a* is being cleaned, a paint solution containing the fluid ejected from the cleaning guns 366*a* through 366*d* and 374, i.e., a mixture of a drain solution and a mist is discharged through the outlet 382 at the lower end of the casing 378 and also through the conduits 384, 386 into the separation tank 388 where the mixture is separated into the drain and the mist. The mist is fed via the conduit 390 into a drain processing unit (not shown), and the drain is delivered by the pump 393 into a drain processing unit (not shown). Therefore, no drain/mist flows into the working space, and a good environment is maintained in the working space.

While the cleaning process for the paint spray gun 140*a* has been described in detail, the other paint spray guns 140*b* through 140*d* are cleaned in the same manner.

The paint spray guns 182*a* through 182*d* of the side painting mechanisms 38, 40 are cleaned as follows:

In the side paint spray gun cleaning device 338, the cylinders 302*a*, 302*b* (FIG. 11) are operated to displace the piston rods 304*a*, 304*b* horizontally to position the cleaning tanks 300*a*, 300*c* supported on the piston rods 304*a*, 304*b* in horizontal alignment with the respective paint spray guns 182*a*, 182*c*. The nozzle ends of the paint spray guns 182*a*, 182*b*, 182*d* are horizontally oriented and positioned, and the gun arm 178 is swung from the side of the vehicle body 14 toward the side paint spray gun cleaning device 338 until the paint spray guns 182*a* through 182*d* confront the cleaning tanks 300*a* through 300*d*, respectively.

The lefthand side painting mechanism 38 is then displaced along the rail 34*a* toward the cleaning device 338, whereupon the nozzle ends of the paint spray guns 182*a* through 182*d* are inserted into the respective cleaning tanks 300*a* through 300*d*. The nozzle ends of the paint spray guns 182*a* through 182*d* are now cleaned in the cleaning tanks 182*a* through 182*d* in the same manner as that in which the paint spray gun 140*a* is cleaned in the cleaning tank 348*a*.

The paint spray guns 182*a* through 182*d* of the right-hand side painting mechanism 40 are similarly automatically cleaned by the side paint spray gun cleaning device 340.

Figure 2:
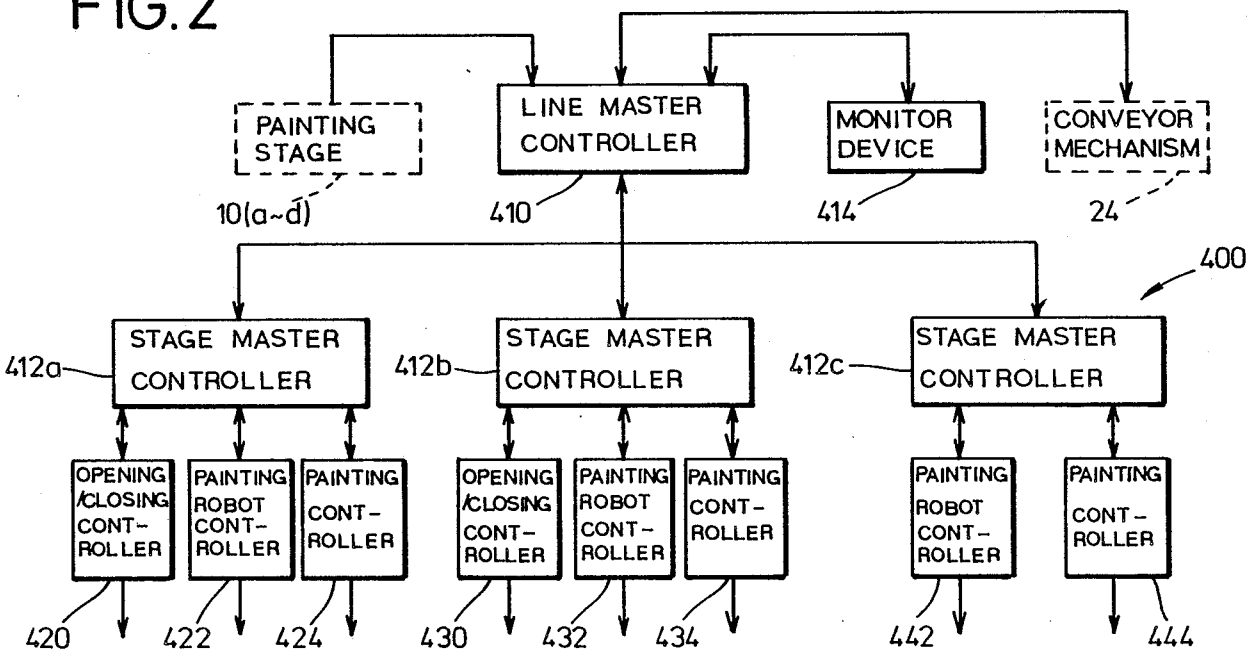
FIG. 2 is a block diagram of a painting control system according to the present invention.
Figure 14A:
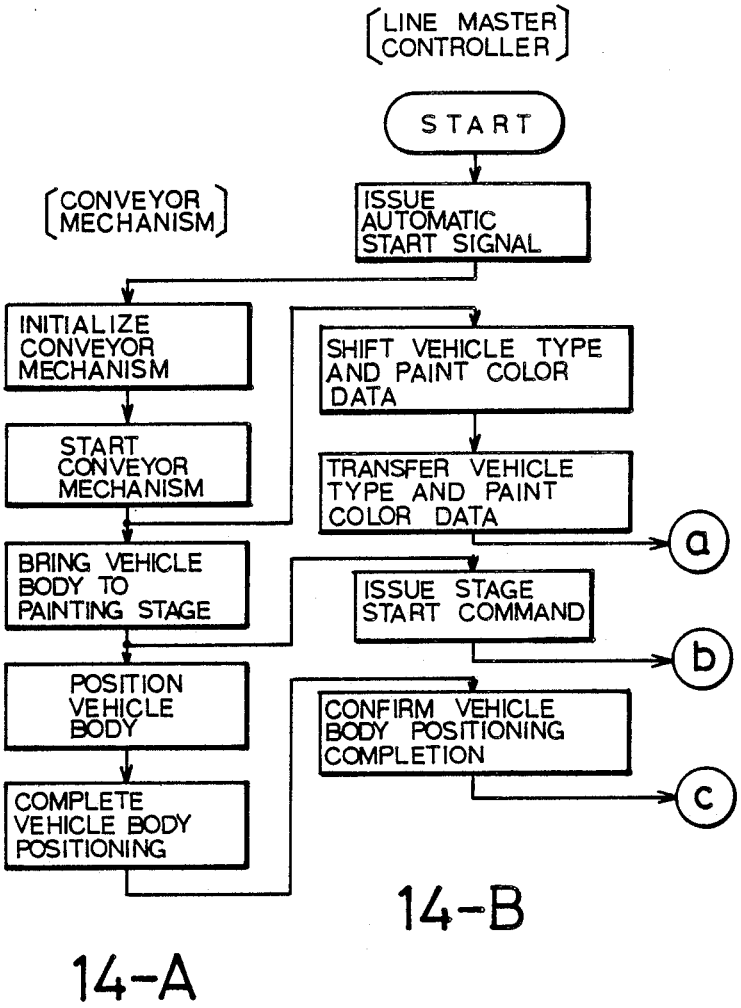
FIG. 14 is a flowchart of a control sequence of the painting control system.
Figure 14B:
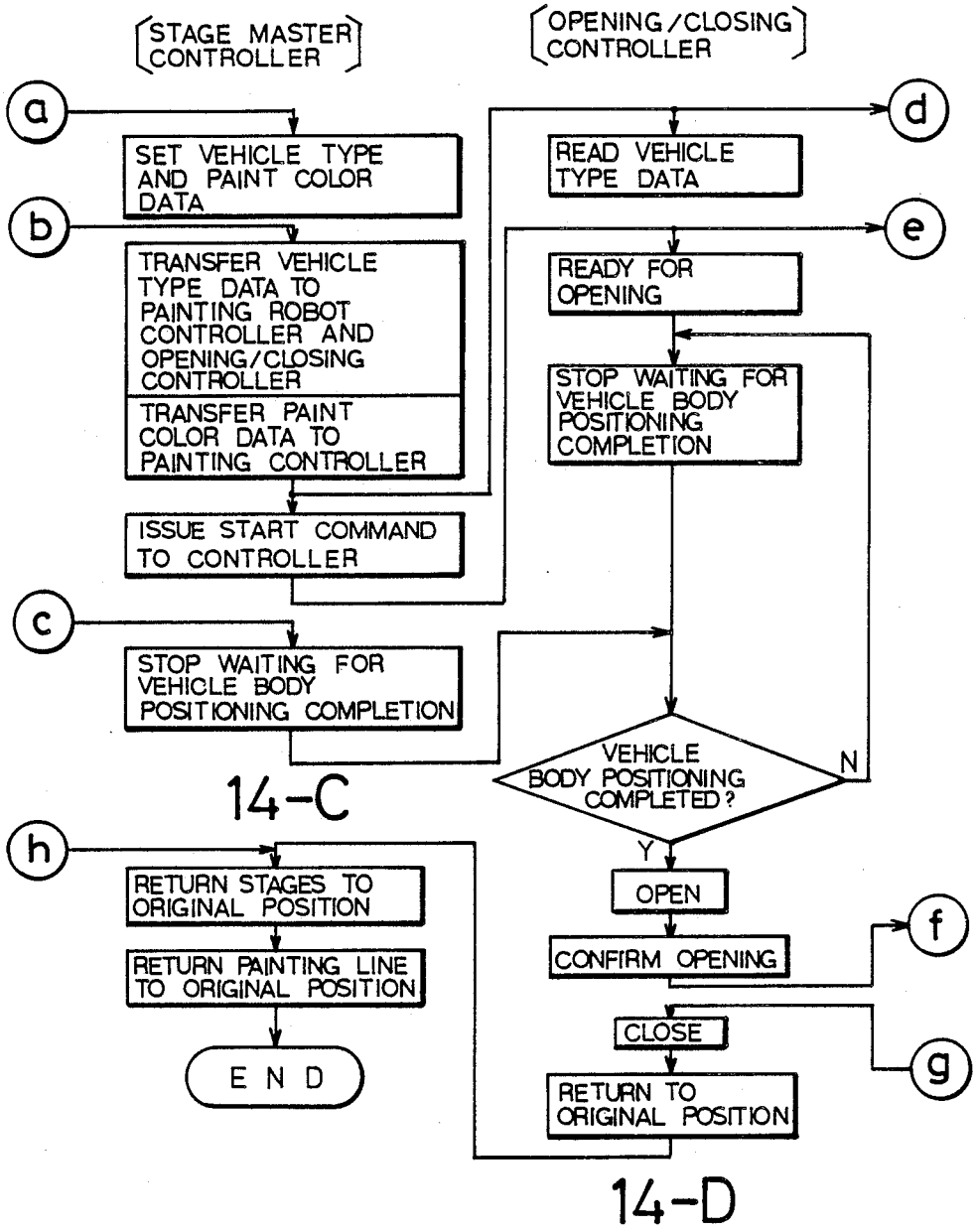
Figure 14C:
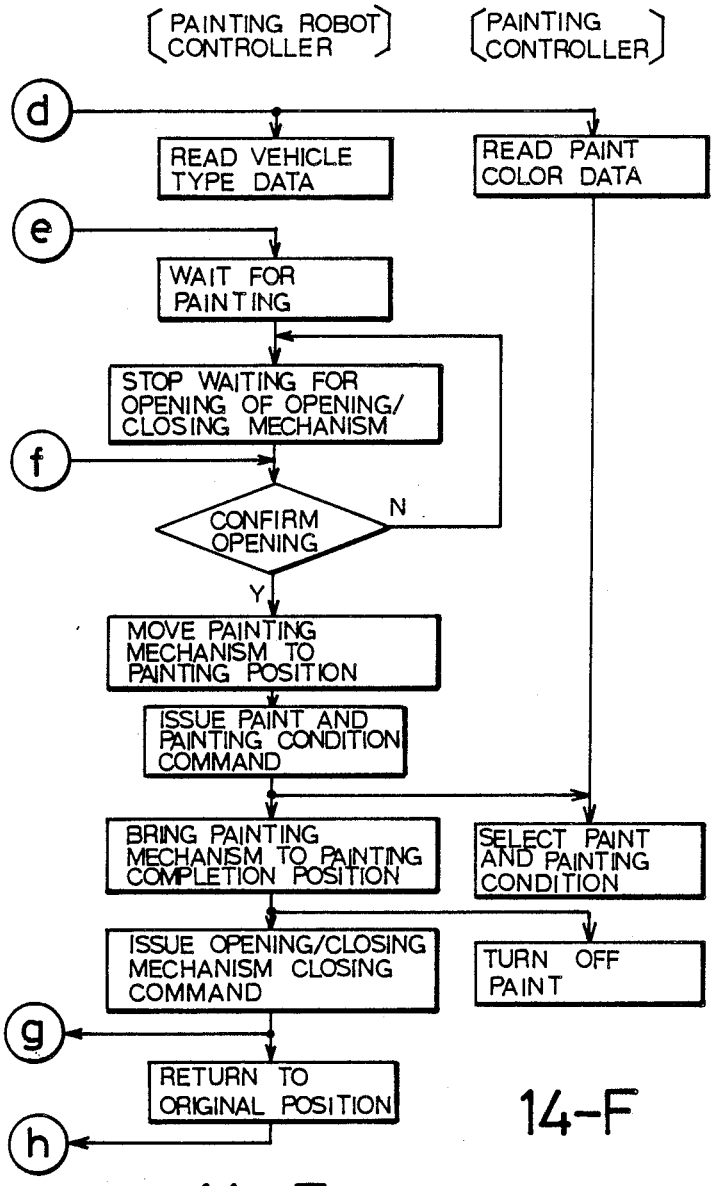

Operation of the painting apparatus of the invention will be described in greater detail. FIG. 14 is a flowchart of operation of the conveyor mechanism and the controllers of the painting control system 400 shown in FIG. 2.

14-A indicates a sequence or flow of operation of the vehicle body conveyor mechanism 24, 14-B a sequence of operation of the line master controller 410, 14-C a sequence of operation of the stage master controllers 412*a* through 412*c*, 14-D a sequence of operation of the opening/closing controllers 420, 430, 14-E a sequence of operation of the painting robot controllers 422, 432, 442, and 14F a sequence of operation of the painting controllers 424, 434, 444.

When a vehicle body 14 to be coated is set on the conveyor mechanism 24 and the line master controller 410 issues an automatic start signal for the painting line, the conveyor mechanism 24 is initialized in position and started (14-A). In synchronism the starting of the conveyor mechanism 24, the line master controller 410 shifts vehicle type and paint color data to a transmission register and then transfers the data to and sets the data in the stage master controllers 412*a* through 412*c* (14-B, 14-C). As the conveyor mechanism 24 advances and the vehicle body 14 reaches a desired one of the painting stages 10*a* through 10*c*, the line master controller 410 issues a start command to a corresponding one of the stage master controllers 412*a* through 412*c*. Based on the start command, the stage master controllers 412*a* through 412*c* transfer the vehicle type data to the associated opening/closing controllers 420, 430 and the painting robot controllers 422, 432, 442, and also transfer the paint color data to the painting controllers 424 through 444. The data items are read by the opening/-closing controllers, the painting robot controllers, and the painting controllers. The stage master controllers 412*a* through 412*c* issue a start command to the opening/closing controllers 420, 430, the painting robot controllers 422, 432, 442, and the painting controllers 424 through 444.

In response to the vehicle type data and the start command, the opening/closing controllers 420, 430 are readied for opening operation and wait for the completion of the vehicle body positioning (14-D). Silimilarly, in response to the vehicle type data and the start command, the painting robot controllers 422, 432, 444 wait for painting operation and also for opening of the opening/closing mechanisms 20, 22, 32*a*, 32*b* in the painting stages 10*b*, 10*c* (14-E).

When the vehicle body 14 is positioned in one of the painting stages 10*a* through 10*c* upon further advance of the conveyor mechanism 24, the line master controller 410 confirms the vehicle body positioning, and applys a positioning confirmation signal to the stage master controllers 412*a* through 412*c* (14-A, 14-B).

In response to the positioning confirmation signal, the stage master controllers 412*a* through 412*c* control the opening/closing controllers 420, 430 to open the opening/closing mechanisms 20, 22 or 32*a*, 32*b*, to confirm the completion of their opening, and to issue an opening completion signal to the painting robot controllers 422, 432, 442 (14-D, 14-E).

In response to the opening completion signal from the opening/closing controllers 420, 430, the painting robot controllers 422, 432, 442 move the corresponding painting mechanisms 18*a* through 18*d*, 28*a*, 28*b* or 36, 38, 40 to their painting position, and issue a paint and painting condition command to the painting controllers 424 through 444 (14-E, 14-F). When the paint and painting condition command is received, the painting controllers 424 through 444 select the indicated paint and painting condition, and control the painting mechanisms 18*a* through 18*d*, 28*a*, 28*b* or 36, 38, 40 to effect painting operation.

Upon arrival of the painting mechanisms 18*a* through 18*d*, 28*a*, 28*b* or 36, 38, 40 at a painting completion position, the painting robot controllers 422, 432, 442 transmit a paint completion signal to the painting controllers 424 through 444, which then turns off the paint (14-E, 14-F). At the same time, the painting robot controllers 422, 432, 442 command closing of the opening/-closing mechanisms 20, 22 or 32*a*, 32*b* corresponding to the opening/closing controllers 420, 430 (14-E).

In response to the closing command from the painting robot controllers 422, 432, 442, the opening/closing controllers 420, 430 close the corresponding opening/-closing mechanisms 20, 22 or 32*a*, 32*b* (14-D).

Upon completion of the closing operation, the opening/closing controllers 422, 432, 442 return the corresponding opening/closing mechanisms 20, 22 or 32*a*, 32*b* to their original position and transmit a returning completion signal to the stage master controllers 412*a* through 412*c*, which then return all of the corresponding painting stages 10*a* through 10*c* to the original position (14-D, 14-C).

When all of the painting stages 10*a* through 10*c* return to their original position, the line master controller 410 returns the entire painting line to the original position, whereupon the painting of the vehicle body 14 is finished (14-B).

FIGS. 15 through 19 show another embodiment of the present invention. In this embodiment, as shown, painting mechanisms are displaceable in a transverse direction of an automotive vehicle body 14, so that the painting operation can be effected in a short period of time for highly efficient operation of the overall painting process.

Figure 15:
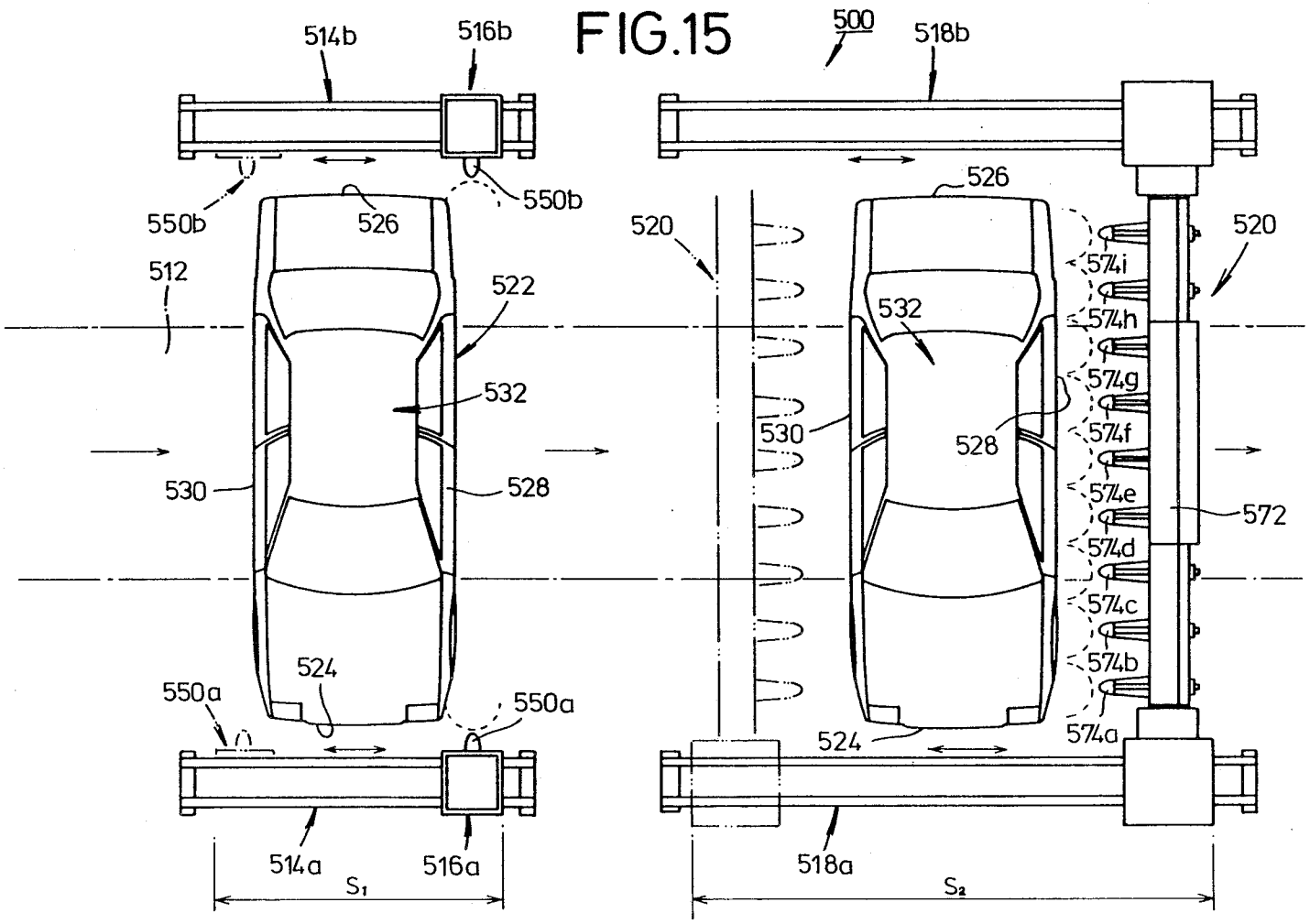
FIG. 15 is a plan view of a painting apparatus for carrying out a painting method according to the present invention.
Figure 16:
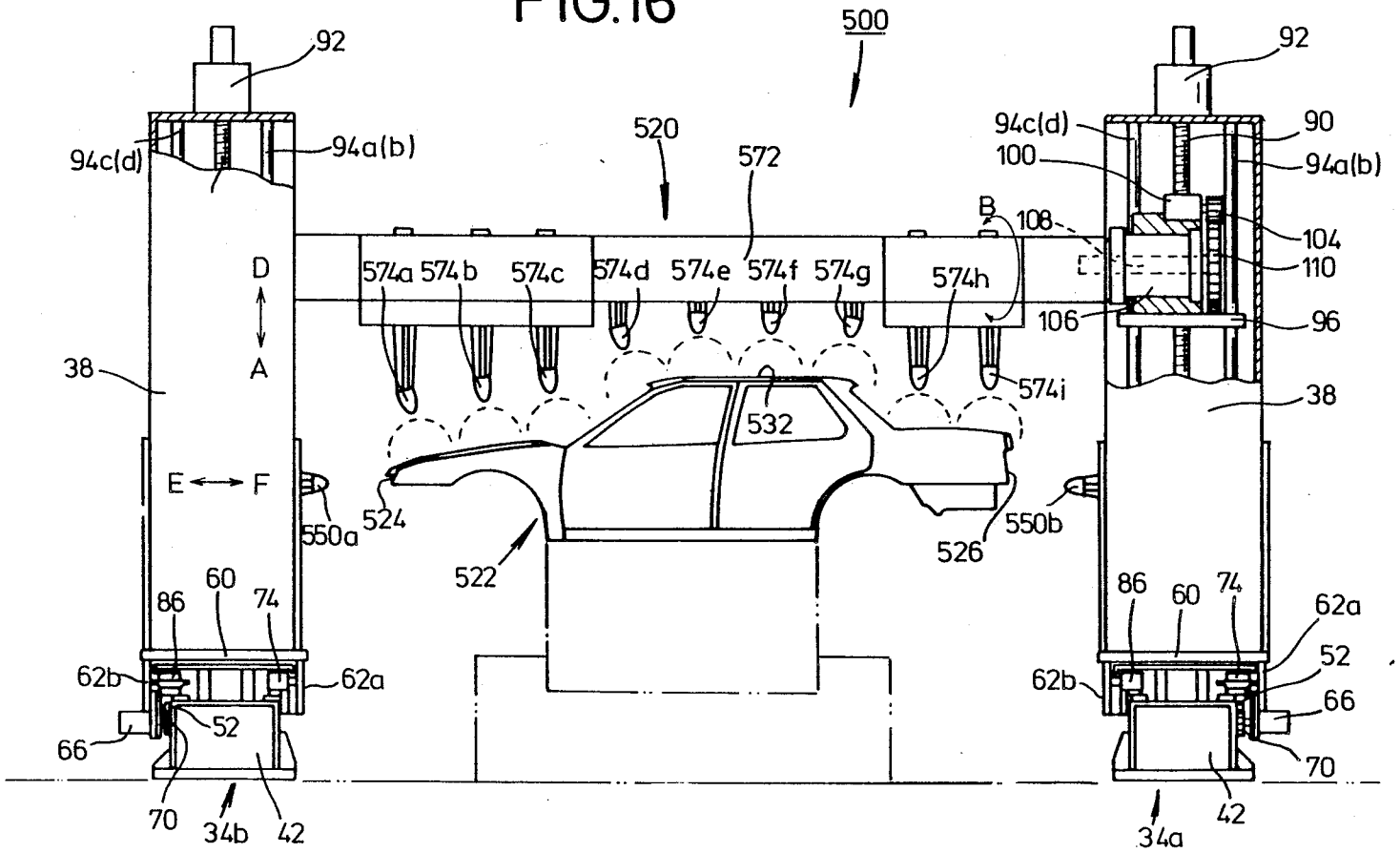
FIG. 16 is a side elevational view, partly in cross section, of the painting apparatus illustrated in FIG. 15.

FIG. 15 illustrates a painting apparatus 500 comprising first rails 514*a*, 514*b* disposed on opposite sides of a vehicle conveyor mechanism 512 extending along a painting line, first painting mechanisms 516*a*, 516*b* movable along the first rails 514*a*, 514*b*, respectively, second rails 518*a*, 518*b* spaced from the first rails 514*a*, 514*b*, respectively, and a second painting mechanism 520 movable back and forth along the second rails 518*a*, 518*b*. An automotive vehicle body 522 has its longitudinal direction substantially perpendicular to the conveying direction (indicated by the arrows). The vehicle body 522 has a front portion 524 and a rear portion 526 which are painted by the first painting mechanisms 516*a*, 516*b*, respectively, and lateral sides 528, 530 and an upper portion which are painted by the second painting mechanism 520.

The first painting mechanisms 516*a*, 516*b* and the second painting mechanism 520 are transported along the first rails 514*a*, 514*b* and the second rails 518*a*, 518*b* by basicaly the same transport means as that of the previous embodiment. Therefore, such transport means will not be described below.

The first painting mechanisms 516a, 516b have horizontally directed paint spray guns 550a 550b which are preferably displaceable in vertical directions (indicated by the arrows A, D in FIGS. 16 and 17) and in horizontal directions (indicated by the arrows E, F in FIG. 16) by means of actuators mounted in the first painting mechanisms 516a, 516b.

The second painting mechanism 520 is described below. The second painting mechanism 520 comprises a pair of vertical mobile posts and an arm 572 movably mounted at its opposite ends on the posts. Paint spray guns 574a through 574i are supported on the arm 572. Since the paint spray guns 574a through 574i are identical in construction, only the paint spray gun 574a will be described in detail.

An attachment plate 576a extending vertically downwardly is secured at one end to the arm 572, and a lifting/lowering cylinder 578a is mounted on the attachment plate 576a. The lifting/lowering cylinder 578a has a downwardly extending piston rod 580a to which there is fixed an attachment member 584a attached to the lower end of a bracket 582a. The bracket 582a accommodates therein a swinging cylinder 586a having a piston rod 588a extending downwardly and projecting a prescribed length from the lower end of the bracket 582a. A rod 590a has one end fixed to the lower end of the bracket 582a parallel to the piston rod 588a, with a swing plate 592a being swingably attached to the other end of the rod 590a. The paint spray gun 574a is mounted on the distal end of the swing plate 592a. The piston rod 588a has its distal end coupled to a joint 594a projecting laterally from the swing plate 592a.

The paint spray gun 574a is of a basic construction as described above. The other paint spray guns 574a through 574i are identical in structure, and their identical components are denoted by identical reference numerals with suffixes b through i.

The paint spray guns 574e, 574f serve to paint the uppermost postion of a roof 532 of the vehicle body 522, and may not be vertically movable with respect to the arm 572. Therefore, the swinging cylinders 586e, 586f thereof may be directly mounted on the attachment plates 576e, 576f, respectively.

The painting apparatus of the second embodiment operates and is advantageous as follows:

As shown in FIG. 15, the first painting mechanisms 516a, 516b are positioned on one end of the first rails 514a, 514b, and the second painting mechanism 520 is positioned on one end of the second rails 518a, 518b, with the paint spray guns 574a through 574i being directed substantially perpendicularly to a lefthand side 528 of the vehicle body 522.

The vehicle body 522 is then moved transversely in the direction of the arrow by the conveyor mechanism 512 until the vehicle body 522 is positioned between the first and second rails 514a, 514b whereupon the vehicle body 522 is stopped. Paint sprays are then ejected from the paint spray guns 550a, 550b of the first painting mechanisms 516a, 516b, during which time the first painting mechanisms 516a, 516b are moved along the first rails 514a, 514b to their opposite end.

More specifically, the first painting mechanisms 516a, 516b are moved in the direction opposite to the direction of the arrow by means of the transport means on the lower ends of the first painting mechanisms 516a, 516b. Thus, the paint spray guns 550a, 550b are moved in the direction opposite to the direction of the arrow while ejecting paint sprays to coat the front and rear portions 524, 526 of the vehicle body 522.

Figure 18:
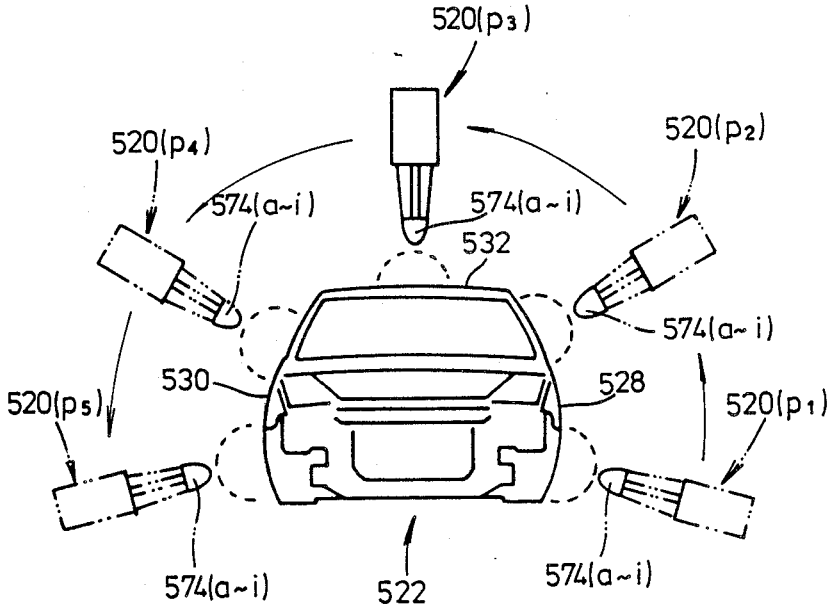
FIG. 18 is a view showing the manner in which an automotive vehicle body is painted by the painting apparatus.

After the front and rear portions 524, 526 of the vehicle body 522 have been painted, the vehicle body 522 is transferred in the direction of the arrow by the conveyor mechanism 512 and then stopped when it reaches a position between the second rails 518a, 518b. The second painting mechanism 520 is then operated to apply paint sprays from the paint spray guns 574a through 574i which are directed substantially perpendicularly to lefthand side, upper, and righthand side portions 528, 532, 530 of the vehicle body 522 and are spaced at prescribed intervals from each other, as shown in FIG. 18.

More specifically, for coating the lefthand side portion 528 of the vehicle body 522 with the second painting mechanism 520, the lifting/lowering motor 92 is driven to move the paint spray guns 574a through 574i from a position P1 to a position P2. The ball screw 90 coupled to the lifting/lowering motor 92 is rotated about its own axis, causing the support plate 96 to lift the arm 572 in the direction of the arrow D. At this time, the turning motor 100 is also driven to rotate the gear 104 supported on its shaft for enabling the gear 100 meshing with the gear 104 to turn the arm 572 in the direction of the arrow B.

Therefore, the paint spray guns 574a through 574i mounted on the arm 572 are directed perpendicularly to the lefthand side 528 of the vehicle body 522. If required, the pinion 70 is rotated by the transport motor 66 to cause the rack 52 to move the casing along the rail bracket in a prescribed direction. As a result, the paint spray guns 574a through 574i can be spaced a constant distance from the lefthand side 548 of the vehicle body 522, so that the paint can uniformly be applied from the paint spray guns 574a through 574i to the lefthand side 528 of the vehicle body 522.

After the lefthand side 528 of the vehicle body 522 has been painted, the gear 104 is rotated by the turning motor 100 to enable the gear 104 to rotate the arm 572 in the direction of the arrow B for thereby orienting the paint spray guns 574a through 574i downwardly. At this time, the paint spray guns 574a through 574i are positionally adjusted so that they are directed substantially perpendicularly to and spaced a desired distance from the engine hood, roof, and trunk lid of the vehicle body 522.

Figure 17:
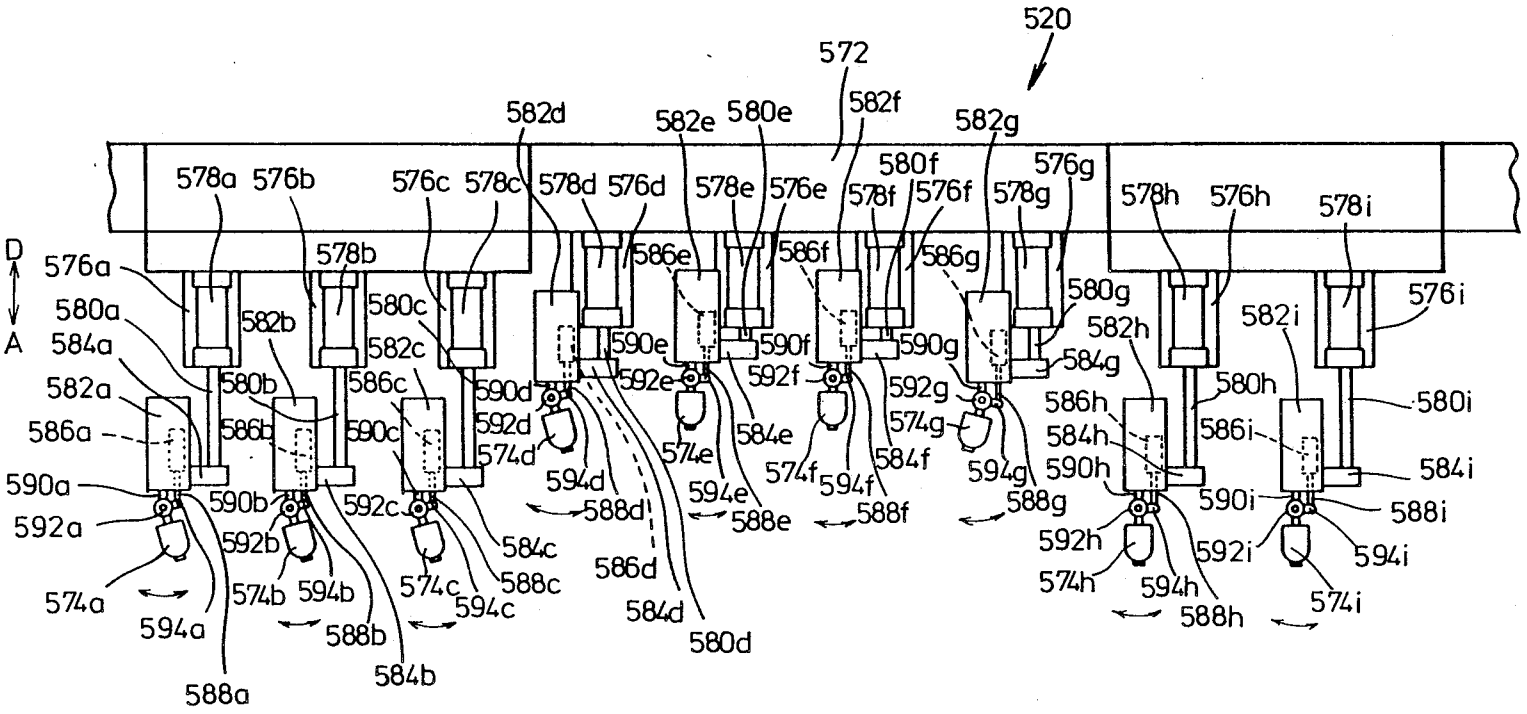
FIG. 17 is an enlarged view of paint spray guns of the painting apparatus.

More specifically, as illustrated in FIG. 17, when the lifting/lowering cylinder 578a is driven to displace the piston rod 580a in the direction of the arrow A, the bracket 582a coupled to the piston rod 580a is lowered. Therefore, the paint spray gun 574a supported by the piston rod 588a of the swinging cylinder 586a disposed in the bracket 582a and also by the rod 590a is displaced in the direction of the arrow A. The lifting/lowering cylinder 578a is inactivated when the paint spray gun 574a reaches a position which is spaced a given distance from the engine hood. Where the surface of the engine hood which faces the paint spray gun 574a is slanted, the swinging cylinder 586a is driven to displace the piston rod 588a is a desired direction. The swing plate 592a is now angularly moved in the direction of the arrow by the joint 594a coupled to the piston rod 588a until the paint spray gun 574a is oriented substantially perpendicularly to the engine hood surface, whereupon the swinging cylinder 586a is stopped.

The paint spray guns 574b, 574c are similarly angularly moved to meet the shape of the engine hood and positioned at a desired spacing therefrom by driving the lifting/lowering cylinders 578*b*, 578*c* and the swinging cylinders 586*b*, 586*c*.

The paint spray guns 574*d* through 574*g* for painting the vehicle body roof are swung to meet the shape of the roof by driving the swinging cylinders 586*d* through 586*g*. During this time, at least the lifting/lowering cylinders 578*d*, 578*g* are driven to displace the piston rods 580*d*, 580*g* in the direction of the arrow A for thereby positioning the paint spray guns 574*d* through 574*g* with respect to the roof.

The paint spray guns 574*h*, 574*i* for painting the trunk lid are positioned a desired distance from the trunk lid by driving the lifting/lowering cylinders 578*h*, 578*i* and the swinging cylinders 586*h*, 586*i*.

In this manner, the paint spray guns 574*a* through 574*i* are positioned with respect to the engine hood, roof, and trunk lid of the vehicle body 522. The pinion 70 is rotated by the transport motor 66 to cause the rack 52 to move the casings in the direction opposite to the direction of the arrow. Therefore, the second painting mechanism 520 passes through a position P3 in FIG. 18 while the upper portion of the vehicle body 522 is fully coated by the paint spray guns 574*a* through 574*i*.

After the upper portion of the vehicle body 522 has been painted, the lifting/lowering cylinders 578*a* through 578*i* are driven to displace the paint spray guns 574*a* through 574*i* a prescribed distance in the direction of the arrow D, and the swinging cylinders 586*a* through 586*i* are operated to turn the nozzle ends of the paint spray guns 574*a* through 574*i* a desired angle in the direction of the arrow. The paint spray guns 574*a* through 574*i* are now positioned in a pattern complimentary to the configuration of the righthand side 530 of the vehicle body 522.

Then, the transport motor 66 is actuated to move the casings in the direction opposite to the direction of the arrow, while at the same time the turning motor 100 is driven to rotate the arm 572 in the opposite direction, and the arm 572 is displaced in the direction of the arrow A by the lifting/lowering motor 92. Therefore, the paint spray guns 574*a* through 574*i* reach a position P4 in FIG. 18 to start painting the righthand side 530 of the vehicle body 522. The lifting/lowering motor 92 and the turning motor 100 are driven to rotate the arm 572 in the prescribed direction and displace the same in the direction of the arrow A. If necessary, the transport motor 66 is operated to move the casings in a direction to orient the paint spray guns 574*a* through 574*i* substantially perpendicularly to the righthand side 530 of the vehicle body 522 and also to space them a desired distance from the righthand side 530, which is thereafter painted.

Then, as shown in FIG. 18, the outer panel surface of the vehicle body 522 is fully coated until the paint spray guns 574*a* through 574*i* reach a position P5, whereupon the paint sprays from the paint spray guns 574*a* through 574*i* are cut off. The painted vehicle body 522 is transferred in the direction of the arrow C by the conveyor mechanism 512.

At this time, a next vehicle body 522 has been transferred to the position between the first rails 514*a*, 514*b*. The front and rear portions 524, 526 of the next vehicle body 522 are then coated by the first painting mechanisms 516*a*, 516*b*. Before the new vehicle body 522 is painted by the first painting mechanisms 516*a*, 516*b*, the transport motor 66 is driven to position the casings as shown in FIG. 15, and the lifting/lowering motor 92 and the turning motor 100 are operated to direct the paint spray guns 574*a* through 574*i* substantially perpendicularly to the lefthand side 528 of the vehicle body 522.

With the present invention, it is possible to paint the vehicle body 522 in a short period of time, and a uniform and sightly paint coat can be applied to the overall outer panel surface of the vehicle body 522.

As described above, the vehicle body 522 is delivered by the conveyor mechanism 512 into the painting apparatus 500 while the sides 528, 530 of the vehicle body 522 extend in a direction substantially normal to the direction in which the vehicle body 522 is transferred (in the direction of the arrow). Therefore, as shown in FIG. 15, the first painting mechanisms 516*a*, 516*b* for painting the front and rear portions 524, 526 of the vehicle body 522 are moved only a distance S1 that is slightly longer than the width of the vehicle body 522 (at the front and rear portions 524, 526) while painting the front and rear portions 524, 526. The second painting mechanism 520 for coating the sides 528, 530 and the top 532 of the vehicle body 522 is moved a distance S2 which is equal to the sum of the width of the vehicle body 522 and an additional distance.

Therefore, the distances that the painting mechanisms 516*a*, 516*b*, 520 must move are smaller than those of the painting mechanisms of the painting apparatus in which the lateral sides of a vehicle body would extend in the direction of delivery of the vehicle body, so that the vehicle body 522 can be coated in a short period of time. Consequently, the painting line with the painting apparatus 500 incorporated therein is rendered highly efficient, and can be shortened in its overall length.

The paint spray guns 574*a* through 574*i* of the second painting mechanism 520 are angularly movable and vertically movable by the arm 572, and are also displaceable into a pattern complementary to the shaft of the vehicle body 522. Thus, paint sprays can be ejected from the paint spray guns 574*a* through 574*i* while they are being directed substantially perpendicularly to and spaced a prescribed distance from the sides 538, 530 and the top 532 of the vehicle body 522. The paint sprays can therefore be uniformly applied against the overall surface of the vehicle body 522 to form a sightly paint coat thereon.

Figure 19:
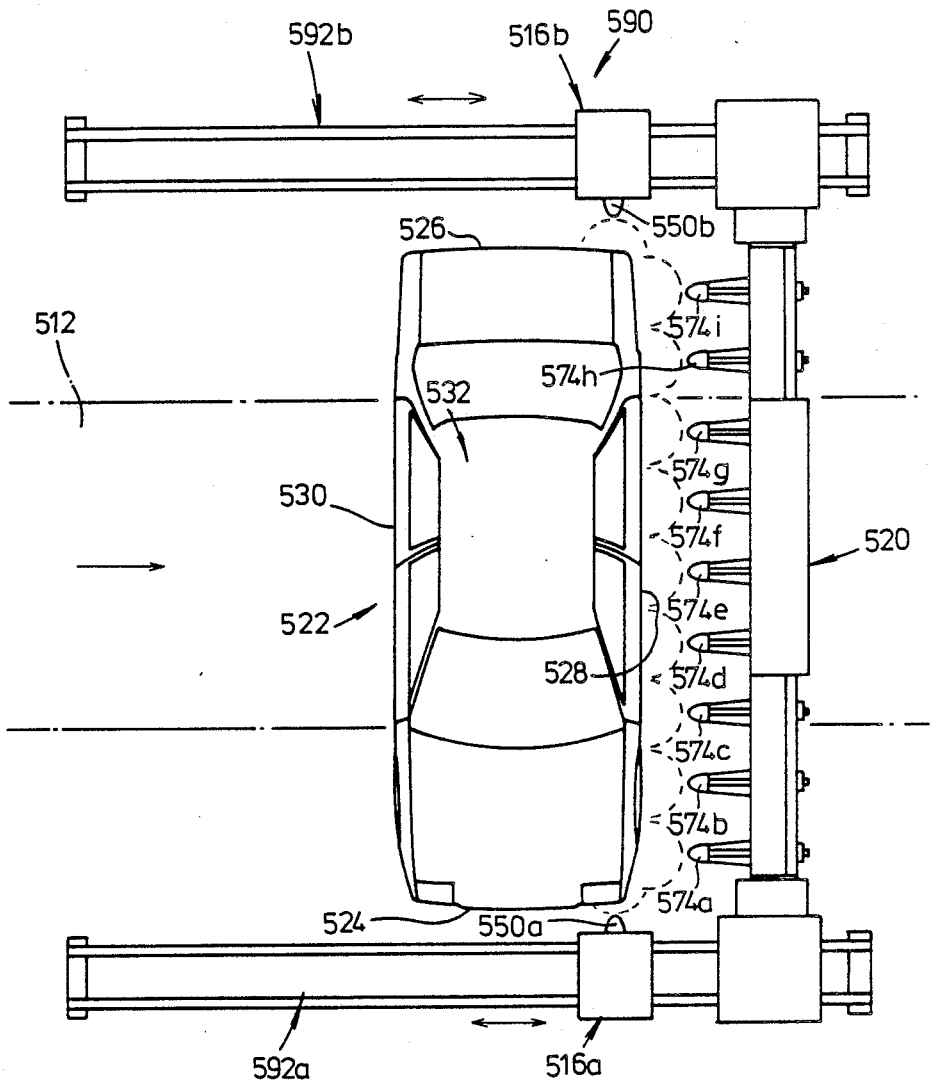
FIG. 19 is a plan view of a painting apparatus according to another embodiment for carrying out the painting method of the invention.

FIG. 19 illustrates a painting apparatus according still another embodiment. Those parts which are identical to those of the preceding embodiment are denoted by identical reference characters, and will not be described in detail.

A painting apparatus 590 according to this embodiment includes a pair of rails 592*a*, 592*b* vertically disposed on opposite sides of the conveyor mechanism 512. A set of casings is movably mounted on the rail 592*a*, whereas another set of casings is movably mounted on the other rail 592*b*.

A vehicle body 522 is transferred by the conveyor mechanisms 512 in the direction of the arrow, and then stopped when it has reached a painting position in the painting apparatus 590. The casings of the first painting mechanism 516*a*, 516*b* are moved along the rail brackets of the rails 592*a*, 592*b* in the direction opposite to the direction of the arrow, during which time paint sprays are ejected from the paint spray guns 550*a*, 550*b* to coat the front and rear portions 524, 526 of the vehicle body 522.

Then, the second painting mechanism 520 is operated to coat the sides 528, 530 and the top 532 of the vehicle body 522 in the sequence described above. More specifically, the arm 572 is vertically moved and angularly moved, and the casings are displaced in a prescribed direction along the rail brackets. The paint spray guns 574*a* through 574*i* are therefore directed substantially perpendicularly to and spaced a desired distance from the lefthand side, upper, and righthand side portions 528, 532, 530 of the vehicle body 522, which are then uniformly painted.

The painting apparatus 590 of this embodiment is advantageous in that since the painting mechanisms 516*a*, 516*b*, 520 are mounted on the pair of rails 592*a*, 592*b*, the space taken up by the painting mechanism 590 is much smaller.

FIGS. 20 through 23 illustrate a further embodiment of the present invention. In this embodiment, holder mechanisms are employed for smoothly holding hoses, cables, and the like which supply driving mediums such as pneumatic pressure, hydraulic pressure, electric power while the painting mechanisms are moved. Those components which are identical to those of the previous embodiments are designated by identical reference characters.

Figure 20:
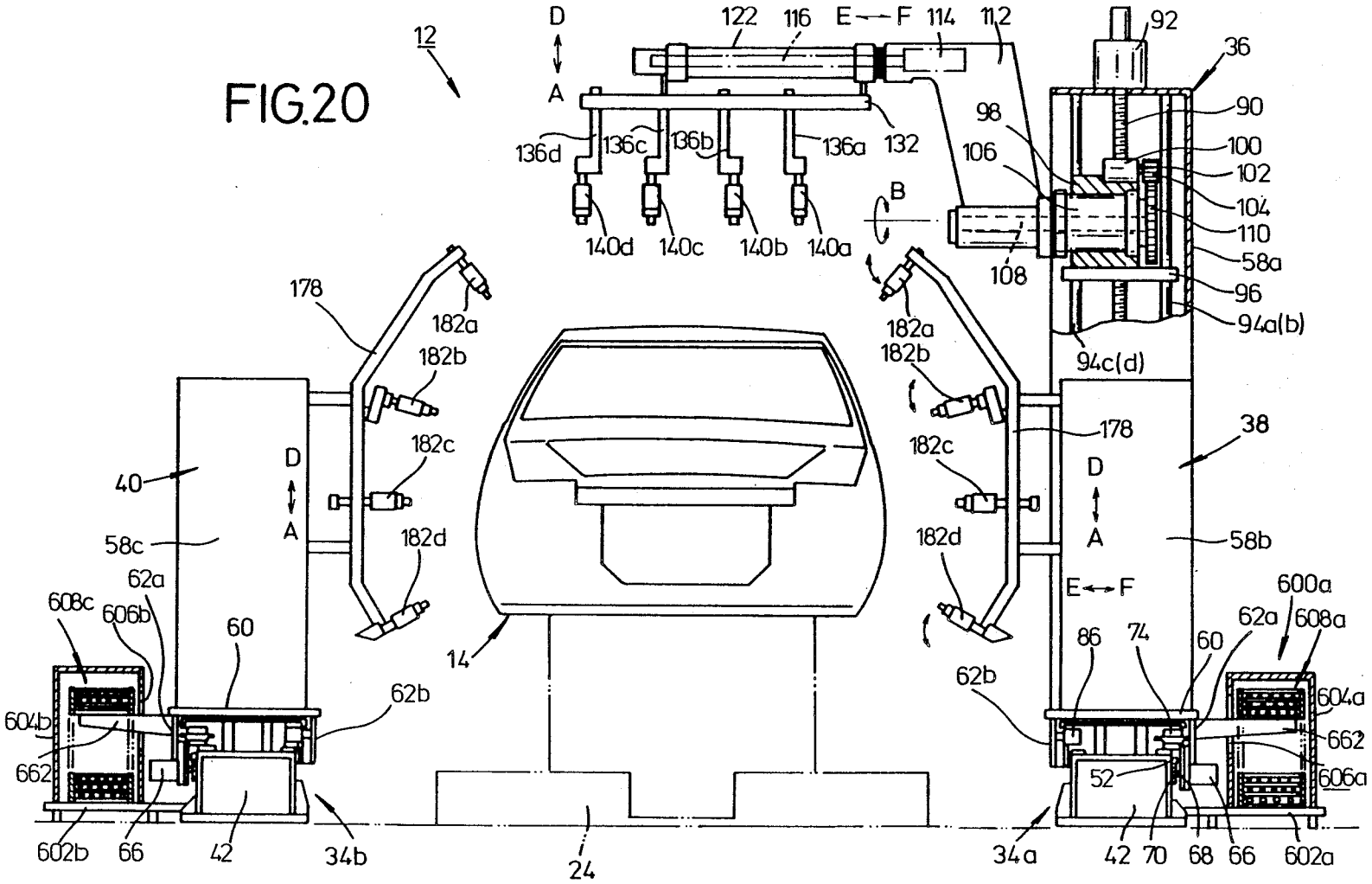
FIG. 20 is a side elevational view, partly in cross section, of a painting apparatus of the invention and a holder mechanism incorporated therein.

As shown in FIG. 20, holder mechanisms 600*a*, 600*b* are disposed outside of the rails.

Figure 21:
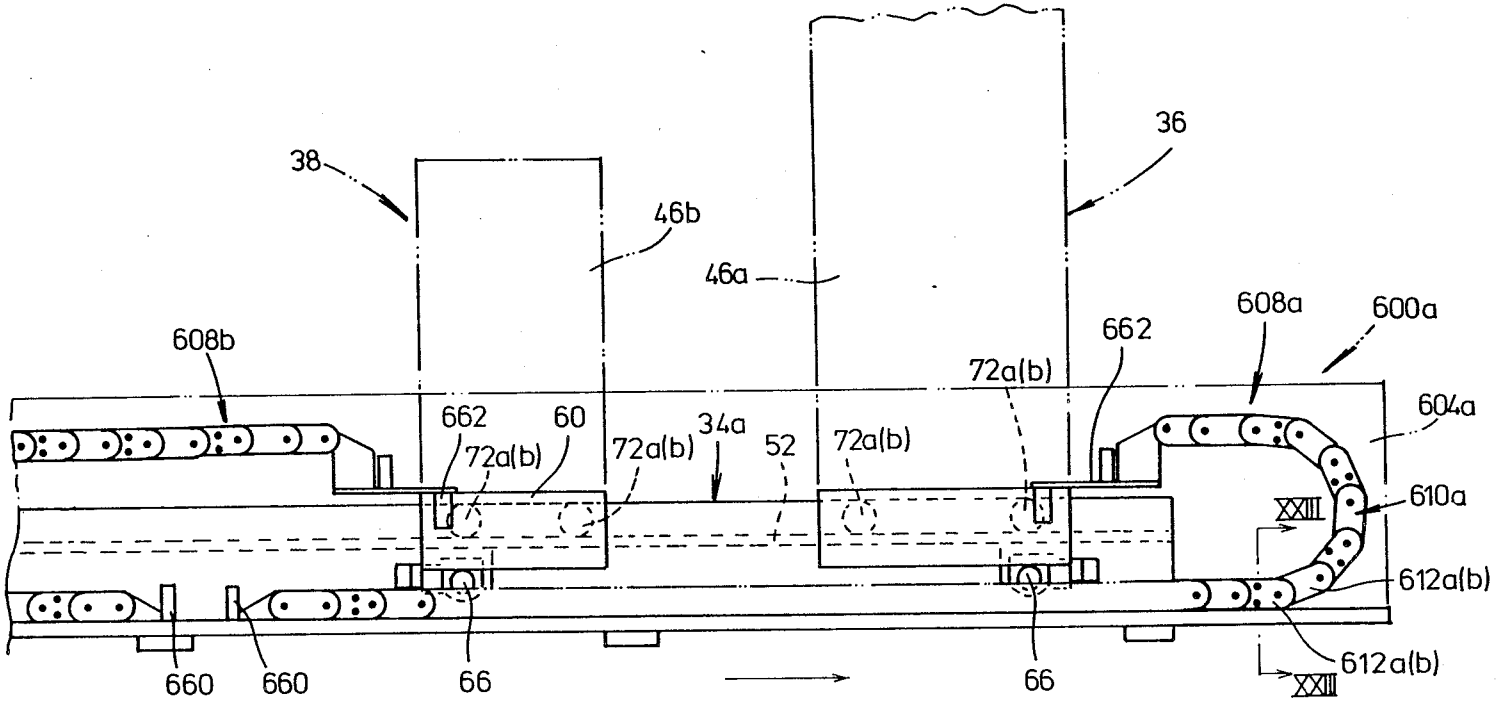
FIG. 21 is a view of the holder mechanism mounted in a side painting mechanism of the painting apparatus.

The holder mechanism 600*a* includes a base 602*a* coupled to the rail bracket 42 of the rail parallel thereto. A box-shaped casing 604*a* is vertically mounted on the base 602*a* and has an opening 606*a* defined in its side panel facing the rail. As illustrated in FIG. 21, first and second racks 608*a*, 608*b* have ends secured substantially centrally to the base 602*a* in confronting relation to each other. The other end of the first rack 608*a* is fixed to the upper painting mechanism 36, whereas the other end of the second rack 608*b* is fixed to the lefthand side painting mechanism 38.

The holder mechanism 600*b* includes a base 602*b* coupled to the rail bracket 42 of the rail parallel thereto. A casing 604*b* having an opening 606*b* is vertically mounted on the base 602*b*. A third rack 608*c* has an end secured to one end of the base 602*b*. The other end of the third rack 608*c* is supported on the righthand side painting mechanism 40.

Since the first through third racks 608*a*–608*c* are identical in construction to each other, only the first rack 608*a* will be described in detail.

Figure 22:
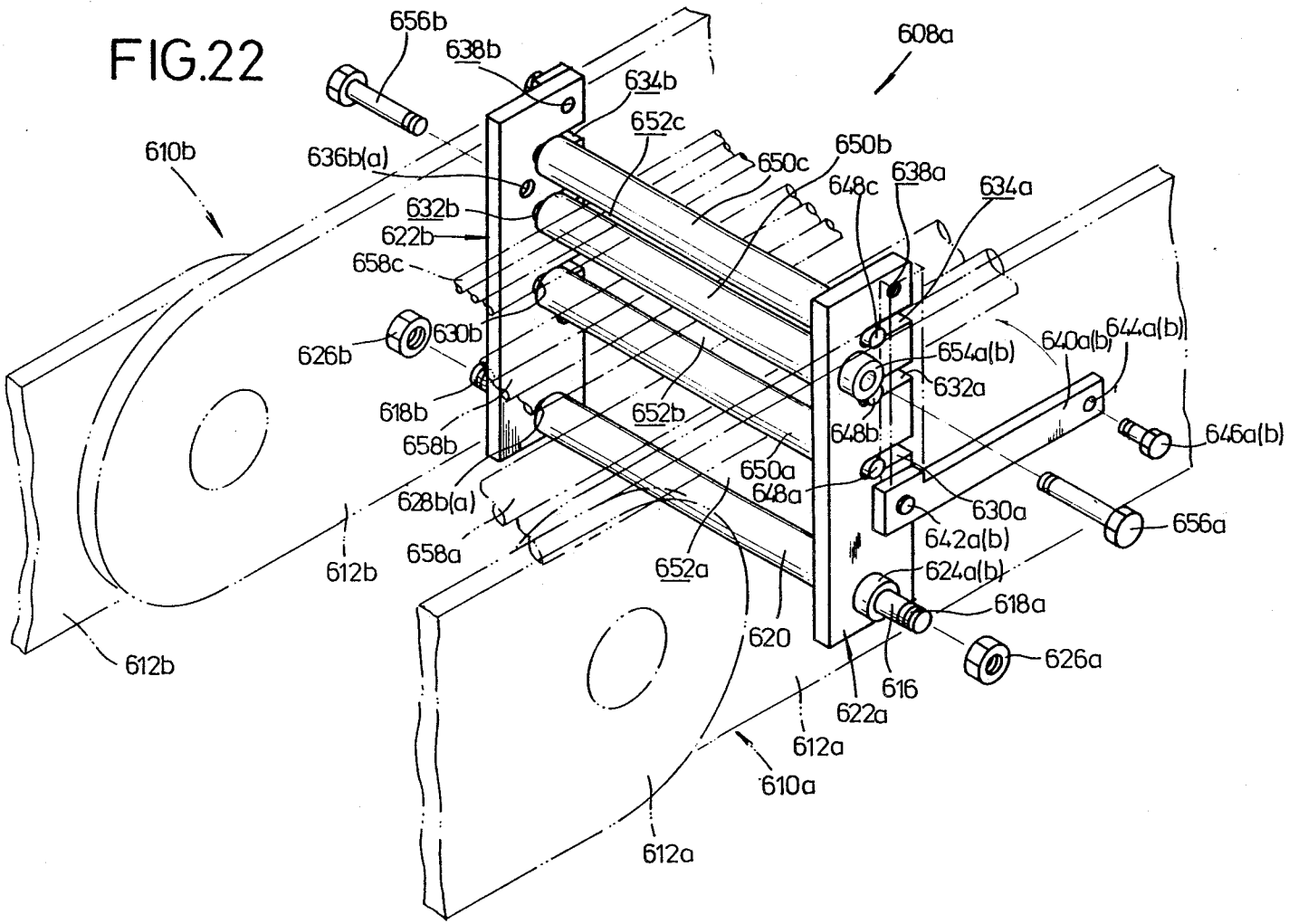
FIG. 22 is a fragmentary perspective view of the holder mechanism.
Figure 23:
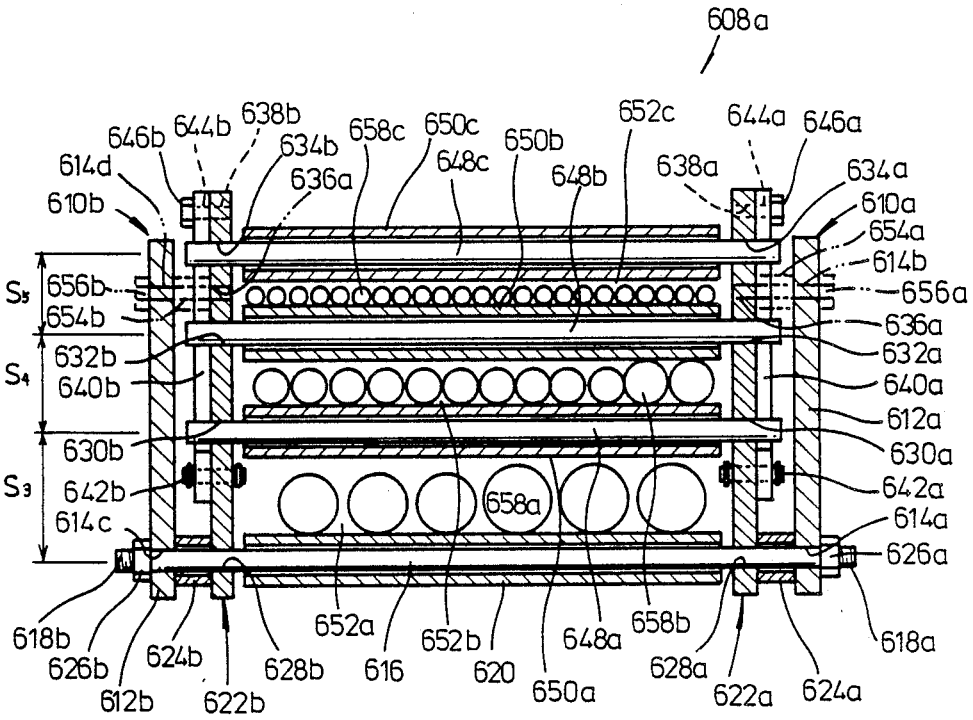
FIG. 23 is a cross-sectional view taken along line XXIII—XXIII of FIG. 21.

As shown in FIGS. 22 and 23, the first rack 608*a* includes a pair of parallel elongate chains 610*a*, 610*b* comprising a plurality of plate-like links 612*a*, 612*b* with their ends angularly movably coupled. The links 612*a*, 612*b* in confronting pairs, for example, alternately have central bolt insertion holes 614*a*, 614*b* and 614*c*, 614*d*. A first partition rod 616 extends through the holes 614*a*, 614*c*, and has externally threaded ends 618*a*, 618*b*. A first guide cylinder 620 having a prescribed length is rotatably fitted over the first rod 616, and extends through ends of support plates 622*a*, 622*b* disposed outwardly of the first cylinder 620. Cylindrical spacers 624*a*, 624*b* are interposed between the support plates 622*a*, 622*b* and the links 612*a*, 612*b*. The first rod 616 is loosely fitted in the spacers 624*a*, 624*b*, and nuts 626*a*, 626*b* are threaded over the externally threaded ends 618*a*, 618*b* thereof.

The support plates 622*a*, 622*b* are of a rectangular shape and have holes 628*a*, 628*b* defined in one end and in which the first rod 616 is fitted. The support plates 622*a*, 622*b* have first grooves 630*a*, 630*b* spaced a distance S3 from the holes 628*a*, 628*b* and extending transversely of the support plates 622*a*, 622*b*. The support plates 622*a*, 622*b* also have second grooves 632*a*, 632*b* spaced a distance S4 from the first grooves 630*a*, 630*b*, and third grooves 634*a*, 634*b* spaced a distance S5 from the second grooves 632*a*, 632*b*. The distances S3, S4, S5 are progressively smaller in the order named.

The support plates 622*a*, 622*b* have threaded holes 636*a*, 363*b* positioned between the grooves 632*a*, 632*b* and the grooves 634*a*, 634*b*, and threaded holes 638*a*, 638*b* at ends near the third grooves 634*a*, 634*b*. Plate-like stoppers 640*a*, 640*b* are angularly movably mounted at one end on the support plates 622*a*, 622*b* by means of pins 642*a*, 642*b*.

The other ends of the stoppers 640*a*, 640*b* have bolt insertion holes 644*a*, 644*b* through which bolts 646*a*, 646*b* are inserted threadedly into the threaded holes 638*a*, 638*b*. Thus, the stoppers 640*a*, 640*b* are mounted on the support plates 622*a*, 622*b* parallel to the longitudinal direction thereof.

Second through fourth partition rods 648*a* through 648*c* are fitted endwise in the first grooves 630*a*, 630*b* through the third grooves 634*a*, 634*b*. Second through fourth cylinders 650*a* through 650*c*, which are similar to the first cylinder 620, are rotatably fitted over the second through fourth rods 648*a* through 648*c*, respectively. Therefore, the first and second cylinders 620, 650*a*, the second and third cylinders 650*a*, 650*b*, and the third and fourth cylinders 650*b*, 650*c* define first through fourth storage spaces or areas 652*a* through 652*c*, respectively, which are progressively smaller in width.

The second through fourth rods 648*a* through 648*c* are mounted on the support plates 622*a*, 622*b* through the stoppers 640*a*, 640*b*, and cylindrical spacers 654*a*, 654*b* are disposed between the support plates 622*a*, 622*b* and the links 612*a*, 612*b*. Bolts 656*a*, 656*b* are inserted through the holes 614*b*, 614*d* of the links 612*a*, 612*b* and also through the spacers 654*a*, 654*b* threaded into the threaded holes 638*a*, 638*b*, thereby fastening the support plates 622*a*, 622*b* to the respective links 612*a*, 612*b*.

The first rack 608*a* accommodates hoses and cables for driving the upper painting mechanism 36 and hoses for supplying the paint to the paint spray guns 140*a* through 140*d* of the upper painting mechanism 36. More specifically, the hoses are divided into a first hose group 658*a* of larger diameter, a second hose group 658*b* of medium diameter, and a third hose group 658*c* of smaller diameter. The first hose group 658*a* is housed in the first storage space 652*a*, the second hose group 658*b* is housed in the second storage space 652*b*, and the third hose group 658*c* is housed in the third storage space 652*c*. One end of the chains 610*a*, 610*b* is fixed to the base 662 through attachments 660, and the chains 610*a*, 610*b* are bent at intermediate portions thereof. The other ends of the chains 610*a*, 610*b* are coupled to attachment bases 662 fixed to the plate 60 of the upper painting mechanism 36. The first through third hose groups 658*a*–658*c* are positionally selected such that the first hose group 658*a* of larger diameter are bent in an outermost position at the bent portions of the chains 610*a*, 610*b*.

Operation and advantages of the holder mechanisms 600*a*, 600*b* will be described below.

When the upper painting mechanism and the side painting mechanisms are displaced, the spray nozzles mounted on the painting mechanisms, the first hose group 658*a*, the second hose group 658*b*, and the third hose group 658*c* which are coupled to the drive sources and other sources are extended. Upon movement of the painting mechanisms, the cables and hoses in the first through third hose groups induce rotation of the first, second, third, and fourth cylinders 620, 650*a*–650*c*. In this embodiment, the support plates 622*a*, 622*b* are disposed between the chains 610*a*, 610*b*, and the first rod 616 and the second through fourth rods 648*a*–648*c* are mounted on the support plates 622*a*, 622*b*, thus defining the first through third storage spaces 652*a*–652*c* which are divided from each other. Since the cables and hoses are divided into the first through third hose groups 658*a*–658*c* according to their diameter, and the first through third hose groups 658*a*–658*c* are stored respectively in the first through third storage spaces 652*a*–652*c*, the hose groups 658*a* thruogh 658*c* can smoothly be displaced without the danger of damage to the hoses which would otherwise be caused by overlapping of the hoses.

More specifically, the cylinders 620, 650*a* through 650*c* are rotatably fitted over the rods 616, 648*a* through 648*c*, respectively. As shown in FIG. 21, when the end of the first rack 608*a* is displaced with the upper painting mechanism 36 along the rail 36*a* and the bent portions of the chains 610*a*, 610*b* are successively moved while the links 612*a*, 612*b* are being relatively angularly moved, the hose groups 658*a* through 658*c* are not frictionally moved against the outer peripheries of the cylinders 620, 650*a* through 650*c*. Therefore, the hoses of the hose groups 658*a* through 658*c* will not be entangled even if the number of those hoses is considerably large, and can also be prevented from moving frictionally with respect to other parts. As a result, any wear or damage to the hose groups 658*a*–658*c* can be reduced as much as possible. The hose groups 658*a*–658*c* can be used for a long period of time, resulting in a highly economical arrangement. As the hose groups 658*a*–658*c* need to be replaced less frequently, the maintenance procedure is simplified, putting a less burden on the workers, and the overall painting process can easily be automated.

For servicing the hose groups 658*a* through 658*c*, the bolts 656*a*, 656*b* are first removed from the threaded holes 636*a*, 636*b*, and the stoppers 640*a*, 640*b* are swung about the pins 642*a*, 642*b*. Then, the rods 648*a* through 648*c* are removed from the grooves 630*a*, 630*b*; 632*a*, 632*b*; 634*a*, 634*b* of the support plates 622*a*, 622*b*. Consequently, the hose groups 658*a* through 658*b* can be handled with utmost ease.

According to the present invention, as described above, a painting line has a conveyor mechanism for conveying an object such as a vehicle body to be painted and a plurality of painting stages disposed for painting different areas of the object, and the overall painting line and the painting stages are controlled by a line master controller, stage master controllers, and working component controllers. Command information indicative of a vehicle type and a paint color is transferred between these controllers in synchronism with the timing of operation of the conveyor mechanism. Therefore, computers of the respective controllers may be of a relatively small procesing capability for efficient control. When an operation sequence (processing program) is to be changed due to changing of vehicle types, the number of vehicles to be produced, or paint colors, it is not necessary to change the entire processing program, but only the operation sequence for those controllers which are involved in such a change needs to be modified. Accordingly, the operation sequence can be modified in a relatively small number of steps, so that the painting control system can easily adapt itself to modifications such as a vehicle type change.

With the arrangement of the invention, furthermore, the lateral sides and top of the object are painted by first, second, and third painting mechanisms which can travel independently along the object. By controlling the first and second painting mechanisms which paint the sides, respectively, of the object, and the third painting mechanism which paints the top of the object so that these mechanisms will run in mutually spaced-apart relationship, paint sprays are prevented from interfering with each other between the sides and the top of the object, so that paint defects such as paint coat irregularities and/or paint runs and sags will not be caused. Since the first, second, and third painting mechanisms can be controlled independently so that discharged paint sprays will not interfere with each other, a paint coat can be applied highly accurately dependent on the configuration of the object easily and in a small number of painting steps.

Paint spraying means are moved along the object by the first painting mechanism and spaced a constant distance from the surface of the object upon movement of the second painting mechanism. The paint spraying means are also directed substantially perpendicularly to the surface of the object by turning means. Thus, an object having curved surfaces can automatically be painted with high accuracy. Where an outer panel surface of an automotive vehicle body is to be painted, the front and rear ends thereof are not required to be manually painted by another independent painting mechanism, as has been the case with the conventional painting apparatus. Therefore, vehicle bodies can be coated with paint in a smaller number of steps and within a shorter period of time.

The painting mechanisms are moved reciprocally, and the paint spraying means thereon are postionally shifted on forward and backward strokes of the painting mechanisms. This allows a more uniform paint coat on the vehicle body, and also an effective use of the paint, with the consequence that a sightly paint coat can be obtained economically.

According to the present invention, moreover, cover members are provided to prevent paint droplets or dust particles from dropping on the object or the path of the paint mechanisms. Accordingly, paint defects such as dust deposits are not produced on the coated surface, and hence a sightly smooth paint coat can be produced. The painting process can automatically and efficiently be effected, and the entire production line can easily be rendered highly efficient. The painting mechanisms can also be cleaned simply by cleaning devices.

Although certain preferred embodiments have been shown and described, it should be understood that many changes and modifications may be made therein without departing from the scope of the appended claims.

What is claimed is:

1. A method of painting an object having opposite side surfaces and an upper surface, comprising the steps of:

positioning said body to remain at rest in a painting position;

applying paint sprays ejected from a plurality of paint spraying means mounted on a plurality of arms to said opposite side surfaces and upper surface, wherein a plurality of paint spraying means are mounted on each said arm such that the paint sprays from each of said paint spraying means do not mutually interfere with each other; and moving said arms independently in mutually positionally displaced relation with respect to said body at rest to allow the paint spray from the paint spraying means to be coated on the surfaces of the object substantially without mutual interference of the paint sprays.

2. A method according to claim 1, wherein surfaces of the object are painted in a first linear pattern by said paint spraying means while moving said arms, and unpainted areas of the surfaces of the object are subsequently painted in a second linear pattern by displacing said paint spraying means.

3. An apparatus for painting an object having opposite side surfaces and an upper surface, comprising:

a first painting mechanism movable along one of said side surfaces for painting said one side surface;

a second painting mechanism movable along the other side surface independently of said first painting mechanism for painting said other side surface;

a third painting mechanism movable along said upper surface independently of said first and second painting mechanisms for painting said upper surface;

said first, second, and third painting mechanisms each includes paint spraying means for applying paint sprays to said object; and a plurality of paint spray means spaced at prescribed distances in a first direction normal to the direction in which said first, second, and third painting mechanism are movable, each of said first, second, and third painting mechanism having shifting means for shifting said paint spray means in said first direction in which they are spaced.

4. An apparatus according to claim 3, wherein said first, second, and third painting mechanisms are displaceable along independent paths, respectively, extending in said painting direction.

5. An apparatus according to claim 3, wherein said paint spray means comprises a first group of spray nozzles spaced at prescribed distances in a first direction normal to a second direction in which said first, second, and third painting mechanism are movable, and a second group of spray nozzles spaced at a prescribed distance from said first group of nozzles and displaced a prescribed interval from said first group of nozzles.

* * * * *